US005548905A

United States Patent [19]

Kuma et al.

[11] Patent Number: 5,548,905

[45] Date of Patent: Aug. 27, 1996

[54] RAPID DEHYDRATING AND DRYING METHOD AND DEVICE USABLE IN LOW TEMPERATURE

[75] Inventors: Toshimi Kuma, Fukuoka; Shinji Kakuya, Sayama, both of Japan

[73] Assignee: Kabushiki Kaisha Seibu Giken, Fukuoka, Japan

[21] Appl. No.: 430,852

[22] Filed: Apr. 28, 1995

[30] Foreign Application Priority Data

Apr. 30, 1994 [JP] Japan ..... 6-126742
Dec. 8, 1994 [JP] Japan ..... 6-222403

[51] Int. Cl.[6] ..... F26B 13/30
[52] U.S. Cl. ..... 34/92; 34/406; 34/412
[58] Field of Search ..... 34/92, 406, 412

[56] References Cited

U.S. PATENT DOCUMENTS 4,231,164 11/1980 Barbee ..... 34/92
4,592,719 6/1986 Bellehache et al. ..... 34/92
4,690,539 9/1987 Radulski et al. ..... 34/92
5,090,132 2/1992 Kobayashi et al. ..... 34/92
5,117,564 6/1992 Taguchi et al. ..... 34/92
5,205,051 4/1993 Hurwitt ..... 34/92
5,377,425 1/1995 Kawakami et al. ..... 34/412

*Primary Examiner*—John T. Kwon
*Attorney, Agent, or Firm*—Staas & Halsey

[57] ABSTRACT

A high speed negative pressure air stream from a sucking-out nozzle or a combination of a high speed negative pressure air stream from the sucking-out nozzle and a high speed air jet stream from a blowing nozzle are used for drying an article. Flanges can be installed at a tip end of the sucking-out nozzle and the blowing nozzle. The air jet stream can be injected obliquely to the surface of the article to be dried. Water adhered to an article to be dried, for example, a wet mat, is rapidly divided into minute water drops which are extracted. Vermin, lice and other contaminants are also removed. The article to be dried is rapidly dehydrated and dried in a low temperature. The sucking-out nozzle provided with a flange in a sucking-out pipe is placed so that it can slide on the surface of the article to be dried. A water drop separating vessel is installed between the sucking-out pipe and the inlet of a blower. A dehumidifier is installed between the outlet of the blower and the blowing pipe. Thus, air is circulated and continuous drying is performed efficiently, without vaporization heat, within a short amount of time and requiring little energy consumption.

30 Claims, 21 Drawing Sheets

RAPID DEHYDRATING AND DRYING METHOD AND DEVICE USABLE IN LOW TEMPERATURE

FIELD OF THE INVENTION

The present invention relates to a rapid dehydrating and drying method and device usable in low temperature with a high speed air stream, used for drying sheet-like articles such as mats, carpets, fabrics, cloths, non-woven fabrics, synthetic resin, glass, film, cardboard and other flat articles.

DESCRIPTION OF THE PRIOR ART

Mats, long-size cloths and sheets, and the like have commonly been dried naturally with ambient atmosphere, dried using heat, dehydrating and drying using centrifugal force, dried using ventilation, dehydrating and drying by pressurizing, and dried using a vacuum under reduced pressure. In vacuum drying under reduced pressure an article to be dried is placed in a chamber and is dried under reduced pressure. To lower the vapor pressure and to evaporate moisture contained in the article to be dried, vaporization heat is taken away. Therefore the article to be dried is cooled and becomes frozen. To prevent this, the article to be dried must be heated, which leads to defects because a great heat energy is necessary and a long period of time is needed for drying. Domesticuse foot mats and business-use door mats, etc., are particularly difficult to dry because various fibers are implanted on a reinforcing rubber sheet or textile fabrics are adhered to a rubber sheet and an air passage does not exist in the direction of the mat thickness. In hot air drying, an article to be dried is dried by evaporating water contained in the article using heating and ventilation. In this instance, a large amount of heat energy for evaporation is needed.

For uniform drying by heating during the manufacturing process of cloths such as long, wide, tight textile fabrics of natural and synthetic fibers, synthetic resin sheets and paper, precise temperature control is needed. At the same time in low temperature drying (below 50° C.), it takes a long period of time. When tatami, thick mats made of rush and straw, and goza, thin rush mats, contain a lot of humidity due to high humidity during the rainy season, hot air of very high temperature (approximately 90° C.) and high pressure (approximately 2000 mmAq) must be used in the prior hot air drying. There is a danger of heat deterioration of the article to be dried. In a dehydrating and drying method using centrifugal force, an article to be dried is put in a rapidly rotating drum to centrifugally remove water for dehydration. In this system, the dehydrated article should be dried again.

SUMMARY OF THE INVENTION

It is an object of the present invention to eliminate the above-mentioned prior art defects.

It is another object of the present invention to provide a continuous, rapidly dehydrating and drying device usable in low temperature which can continuously dehydrate and dry an article to be dried in low temperature (below approximately 60° C.).

It is a further object of the present invention to remarkably shorten the time period necessary for dehydrating and drying, and greatly conserve energy without compromising the article to be dried.

It is yet another object of the present invention to use a high speed negative pressure air stream or combination of high speed negative pressure air stream and high speed air jet stream to obtain the above-mentioned objects.

The above-mentioned objects of the present invention, which dehydrate and dry wet articles such as textile fabrics, implanted sheets and carpets, especially mats with air-impermeable rubber sheet lining, are obtained by continuously sucking out water adhered to fiber gaps and water saturated and adhered to fibers by employing a strong negative pressure air stream at a sucking-out opening or in conjunction with a high speed air jet stream and high speed negative pressure air stream such that both streams join and the streams are further accelerated by using a sucking-out nozzle and a blowing nozzle.

The present invention also performs continuous and efficient drying by providing flanges (barriers) at the tip circumferences of the blowing nozzle and the sucking-out nozzle. The flanges prevent reciprocal short cuts between the high speed jet air stream and the high speed negative pressure air stream and between the atmosphere and each of the high speed jet air stream and the high speed negative pressure air stream. The high speed negative pressure air stream and the high speed jet air stream are adjacent to each other. Water drops adhered to fiber gaps of a mat and water saturated in and adhered to the fibers are transferred into the negative pressure zone of the sucking-out nozzle. The water drops are extracted from the fibers and become minute water drops on the high speed negative pressure air stream from the sucking-out nozzle. The water drops are then transferred upward from the root of the fibers and sucked out and exhausted by the sucking-out pipe.

In the present invention, dehydration means provides not more than 70% water removal from the article to be dried, dehydration/drying means provides 70–86% water removal from the article to be dried, and drying means provides 86–95% water removal from the article to be dried. Further, absolute drying means provides 95–100% water removal from the article to be dried. The above percentages are with respect to the ratio of water removal when the maximum water content of the article to be dried is 100%. For example, when the article to be dried has a maximum water content of 1 kg and 0.9 kg of water is removed, this is a case of 90% drying.

These objects, together with other objects and advantages which will be subsequently apparent, reside in the details of construction and operation as more fully hereinafter described and claimed, reference being had to the accompanying drawings forming a part hereof, wherein like reference numerals refer to like parts throughout.

DESCRIPTION OF THE PREFERRED EMBODIMENTS

Figure 4:
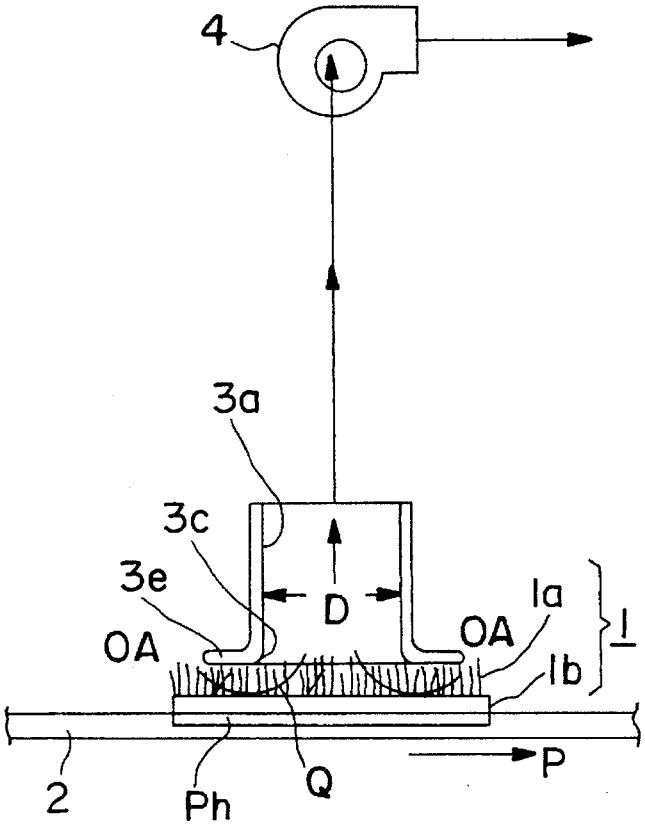
FIG. 4 is a section of a dehydrating device according to the present invention using only a sucking-out nozzle with a flange.
Figure 5:
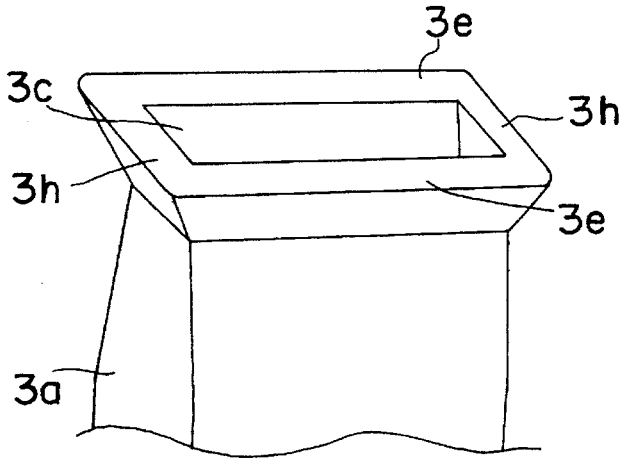
FIG. 5 is a perspective view of a sucking-out nozzle shown in FIG. 4.
Figure 6:
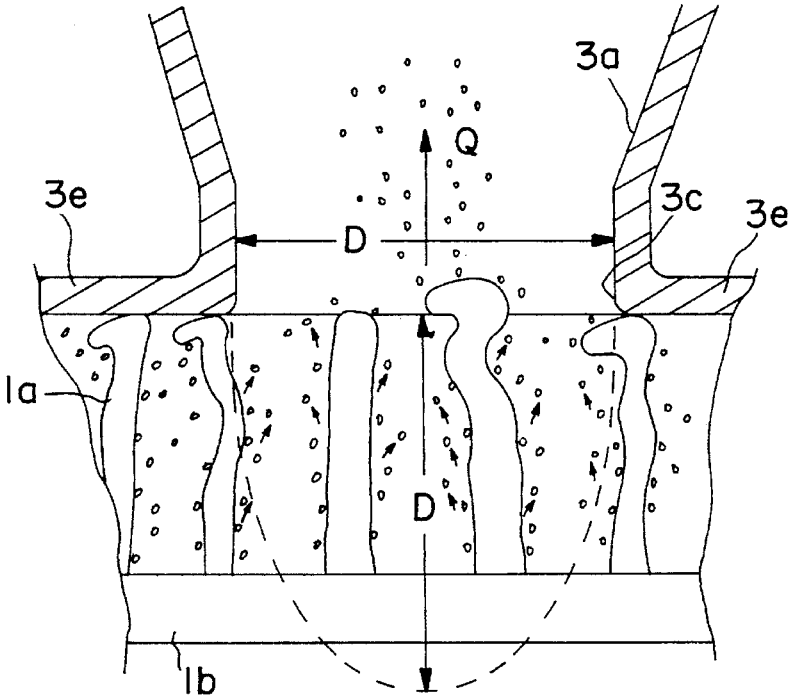
FIG. 6 is a vertical sectional view of the inner diameter D of the sucking-out nozzle shown in FIG. 5.

FIG. 4 is an example of a dehydrating and drying device of the present invention using a water sucking-out pipe 3*a*. FIG. 5 is a perspective view of the sucking-out pipe 3*a*. A wet mat 1 having a large number of fibers 1*a* implanted in an air impermeable rubber sheet base material 1*b* is fixed as an article to be dried on a mobile stand 2. A sucking-out nozzle 3*c* of the sucking-out pipe 3*a* is provided with a flange 3*e* having a width of approximately 5–50 mm in its tip end circumference. The sucking-out nozzle 3*c* is placed so that it approaches or, preferably, touches and slides against the upper surface of the fibers 1*a* of the mat 1. The inlet of a blower 4 is connected to the sucking-out pipe 3*a*. The back surface of the base material 1*b* is heated, for example, by a plate heater Ph. The mat 1 is moved with the stand 2 at the speed of approximately 5–50 mm/sec. in the direction shown by the arrow P in FIG. 4. The zone that negative pressure reaches from the sucking-out nozzle 3*c* is generally considered to be within the area D (see FIG. 6) and negative pressure rapidly increases as the position gets closer to the area D near the sucking-out nozzle 3*c*. When the sucking-out nozzle is closed, the value of negative pressure in the sucking-out pipe becomes equal to that in the inlet of the blower 4. Negative pressure means pressure lower than atmospheric pressure (1 kg/cm$^2$).

Figure 7:
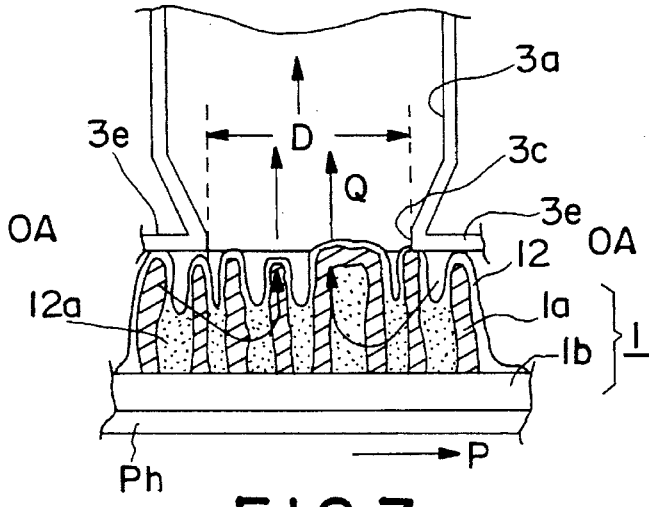
FIG. 7 is an enlarged cross section of a sucking-out nozzle with flanges contacting a mat whose fibers are covered with water membranes.

When the blower 4 is operated, water adhering to gaps of the fibers 1*a* of the mat 1 and laminar water (herein-after referred to as water membranes) impregnated into fibers 1*a* are sucked-up by the high speed negative pressure air stream Q at the sucking-out nozzle 3*c* of the sucking-out pipe 3*a* as shown in FIG. 7. The water becomes continuous water drops 13 (FIG. 8), and numerous minute water drops 14 (FIG. 9) at the surface of the fibers 1*a* due to surface tension of the water. The water drops are sucked out on the high speed negative pressure air stream into the sucking-out pipe 3*a* and the mat 1 is dried. In this case evaporation of water also takes place. Plate heater Ph is provided to heat and to accelerate the drying of the mat 1 to prevent lowering of the temperature of the mat 1 itself by the vaporization heat, especially in winter. As the flange 3*e*, provided at the tip end circumferential part of the sucking-out nozzle 3*c*, slides over the mat, outer air OA cannot flow directly into the sucking-out nozzle 3*c*, passing the surface of the flange 3*e* and contacting the fibers. But outer air OA does enter from under the flange 3*e* into the gaps of the fibers 1*a* of the mat 1 to the surface of the rubber sheet 1*b*, to become the negative pressure stream Q. The water mentioned above becomes minute water drops adhering from the bottom to the top of fibers 1*a*. The minute water drops are carried into the sucking-out nozzle 3*c* by the negative pressure air stream Q and discharged from the sucking-out pipe 3*a*.

In the above-mentioned embodiment, a dehydrating and drying device using one sucking-out pipe 3*a* having a water sucking-out nozzle 3*c* with a flange 3*e* in its tip end circumferential part is shown. It is possible to use a dehydrating and drying device with at least two sucking-out pipes 3*a* fixed in parallel to perform rapid dehydrating and drying several times faster than the case using one sucking-out pipe, by continuously dehydrating and drying in the manner set forth above.

Figure 10:
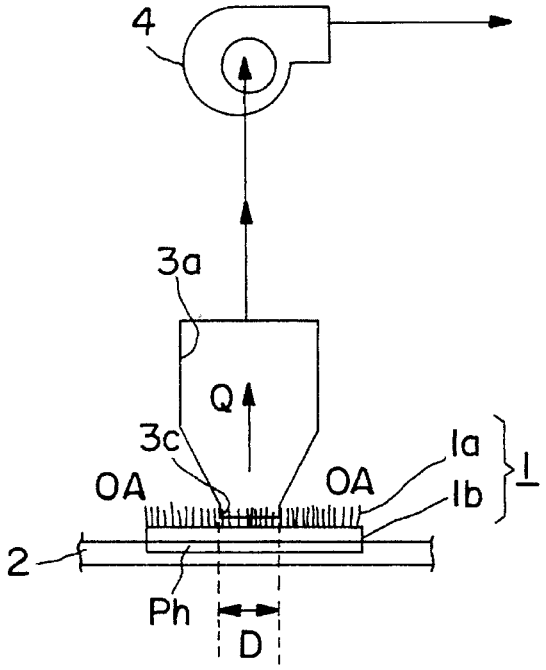
FIG. 10 is a cross section of the dehydrating device of the present invention shown in FIG. 4 using only the sucking-out nozzle without a flange.

FIG. 10 is a dehydrating and drying device as described as above but with a sucking nozzle 3*c* without a flange 3*e* at its tip end circumference. When there is no flange 3*e*, outer air OA enters readily from the bottom of the sucking-out nozzle 3*c*. This requires twice the drying time. In the present example, as the sucking nozzle 3*c* is arranged to upwardly generate the negative pressure air stream Q, in a direction against gravity, the negative pressure in the sucking-out nozzle 3*c* is preferably more than −800 mmAq. When the nozzle 3*c* is arranged to downwardly generate the negative pressure air stream Q, the negative pressure in the sucking-out nozzle 3*c* may be approximately −500 mmAq.

Figure 11:
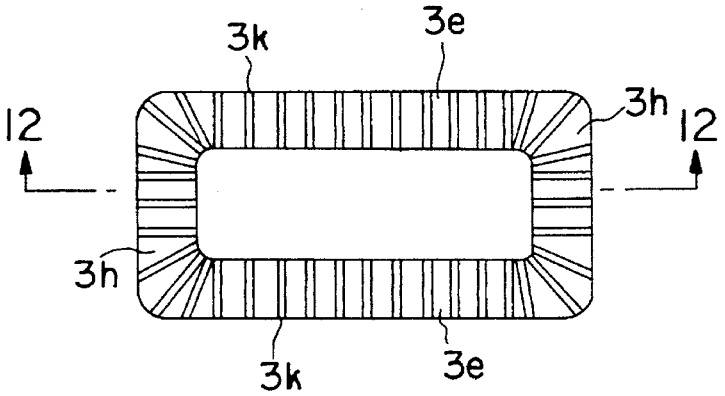
FIG. 11 is a plan view of a sucking-out nozzle having a bottom surface of a flange provided with grooves according to the present invention.
Figure 12:
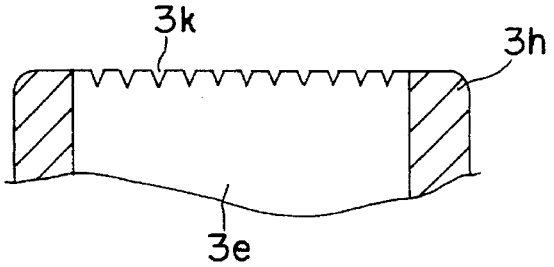
FIG. 12 is a sectional view taken along the line B—B of FIG. 11.
Figure 13:
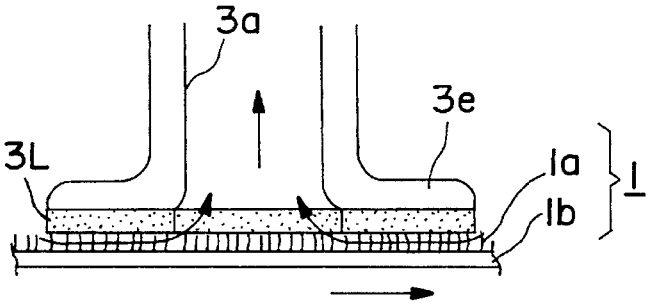
FIG. 13 is a vertical sectional view showing a flange of a sucking-out nozzle having a cloth attached on its bottom face.

When an article to be dried has a dense, smooth surface such as, for example, cloths, mats, glass, synthetic resin film and metal sheet, is dried, as shown in FIGS. 11 and 12, numerous grooves 3*k* are installed in the direction of the bottom width of the flanges 3*e* and 3*h* provided in the tip end circumferential part of the sucking-out nozzle 3*c*. Because of the grooves 3*k*, the article to be dried does not stick up into the sucking-out nozzle 3*c* when being sucked as the outer air OA passes through the grooves 3*k* even when the wet article to be dried touches and slides along the sucking-out nozzle 3*c*. Thus dehydrating and drying at low temperature is possible while the article to be dried touches and slides along the sucking-out nozzle 3*c* and the outer air OA passes through the grooves 3*k*. Further, the article can be dehydrated and dried by increasing the negative pressure by attaching a porous cloth 3L at the bottom of the flanges 3*e* and 3*h* as shown in FIG. 13.

Figure 1:
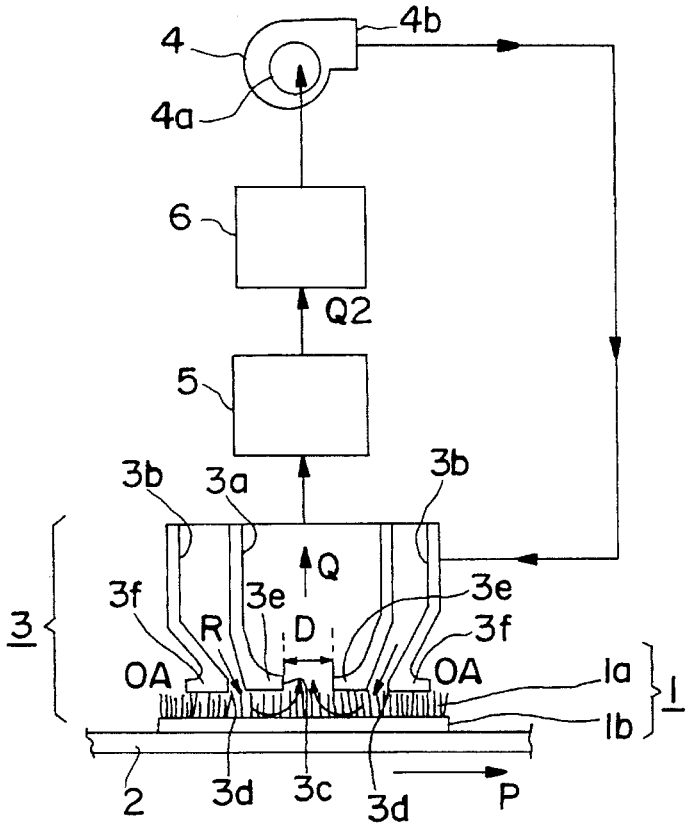
FIG. 1 is a block diagram of a dehydrating and drying device according to the present invention using a component comprising a sucking-out nozzle and a blowing nozzle, both provided with flanges.
Figure 2:
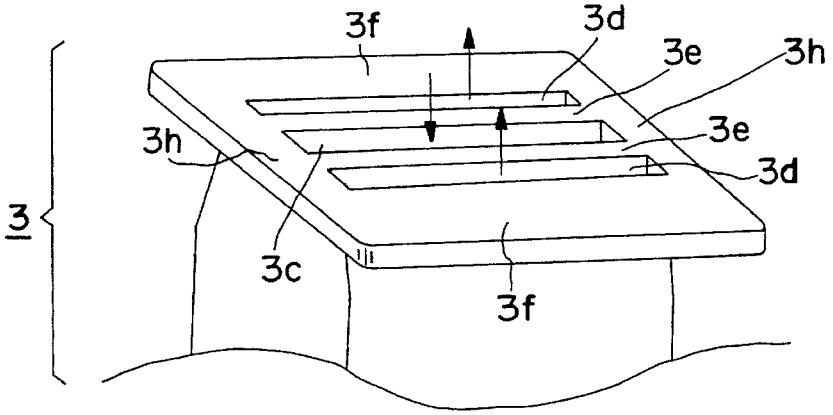
FIG. 2 is a perspective view of the component shown in FIG. 1.
Figure 3:
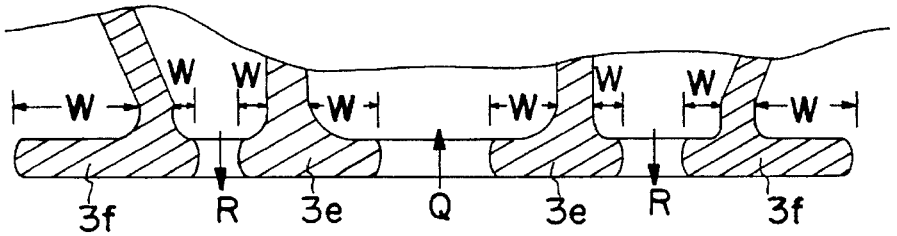
FIG. 3 is an enlarged cross section of the component shown in FIG. 1.

As shown in FIGS. 1, 2 and 3, a dehydrating and drying device using a component 3 is formed by providing a sucking-out nozzle 3*c* having a flange 3*e* in its circumferential part and adjacent to high speed jet blowing nozzles 3*d* having flanges 3*f* in their circumferential part. A water drop separating vessel 5 (FIG. 1) is provided between the sucking-out nozzle 3*c* and an inlet 4*a* of a blower 4.

Figure 14:
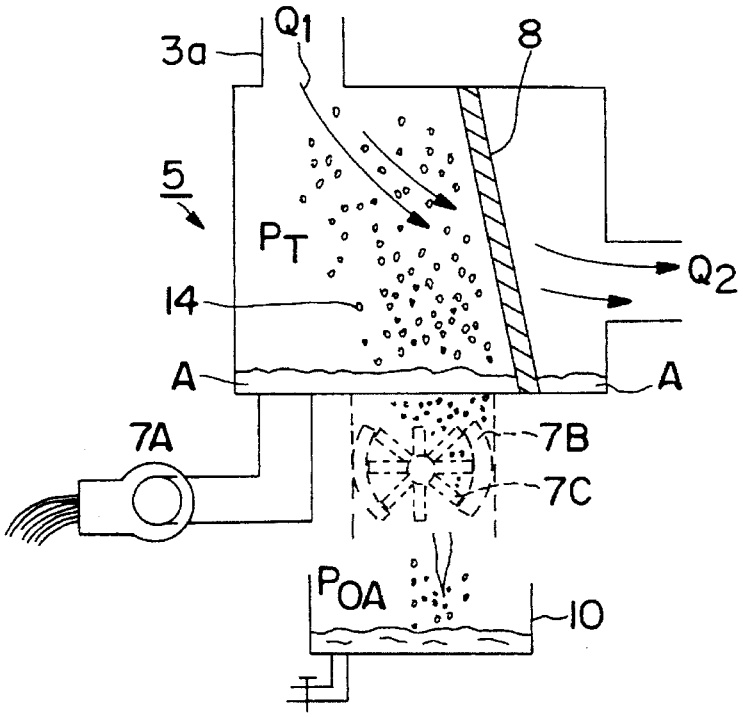
FIG. 14 is a sectional view of a water drop separating vessel.

The water drop separating vessel 5 is provided with a water drop discharging pump 7*a* at the bottom of the vessel and a filter 8 to catch water drops and dust as shown in FIG. 14.

A dehumidifier 6 is placed between the water drop separating vessel 5 and the inlet 4*a* of the blower 4 (FIG. 1). A rotary honeycomb type dehumidifier (FIG. 15) is preferably used as the dehumidifier 6. A pressure swing adsorption (PSA) system or thermal swing adsorption (TSA) system may also be used. The width W of the flanges 3*e* at the tip end circumferential part of the sucking-out nozzle 3*c* and the width W of the flanges 3*f* and 3*h* provided at the tip end circumferential part of the component 3 (FIGS. 2 and 3) is approximately 5–50 mm.

The mat 1 is put on a mobile stand 2 with the fibers 1*a* side up as shown in FIG. 1.

Figure 16:
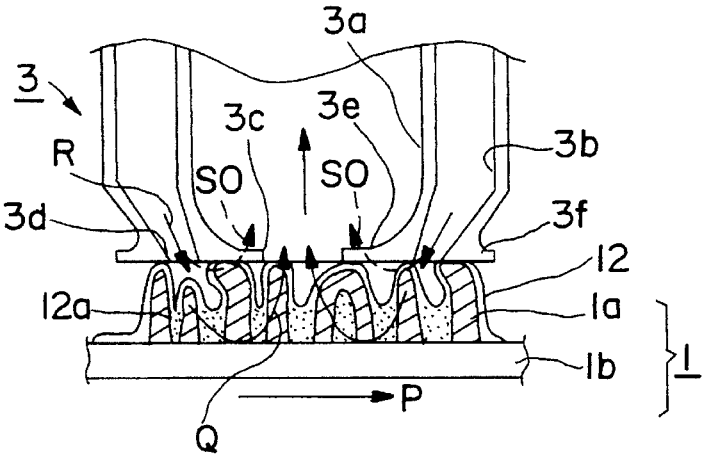
FIG. 16 is an enlarged view of a mat having fibers covered with membranes of water contacting a component having a flange.
Figure 17:
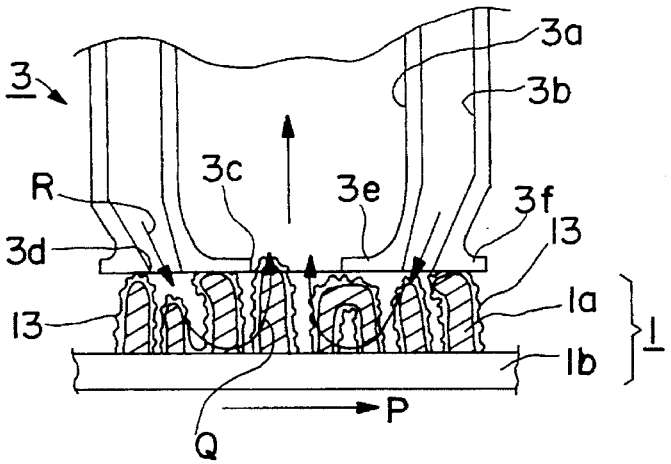
FIG. 17 is an enlarged view of fibers of a mat covered with continuous water drops due to a negative pressure air stream and an air jet stream of a component having a flange.
Figure 18:
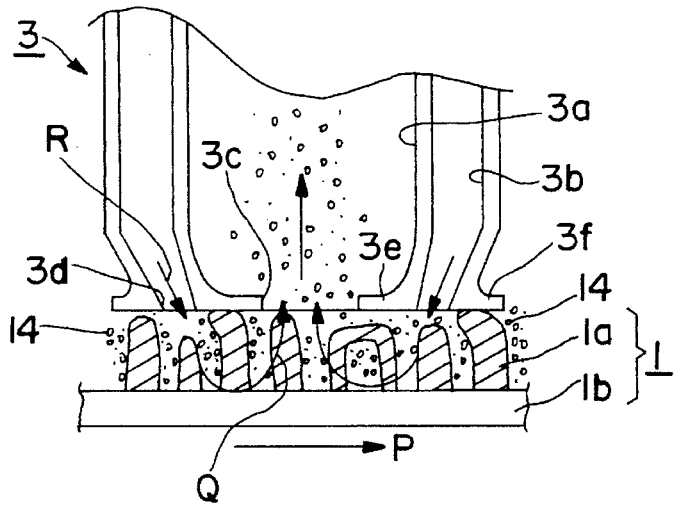
FIG. 18 is an enlarged view showing how water drops and water membranes change to minute water drops due to a negative pressure air stream and air jet stream of a component having a flange.

The component 3 is fixed and the mat 1 is conveyed along with the mobile stand 2 in the direction shown in the drawing as an arrow P at the speed of approximately 5–50 mm/sec. The upper surface of the fibers 1*a* of the mat 1 and the component 3 contact, press and slide against each other. The surface of the fibers 1*a* of the wet mat 1 after washing is covered with water membranes 12 as shown in FIG. 16. Water 12*a* is collected between the fibers 1*a*. When the blower 4 (FIG. 1) is operated, a high speed air jet stream R from the jet blowing nozzles 3*d* does not form a short cut with the negative pressure air stream Q and outer air OA directly near the surface of the flange 3*e* , but reaches deeply into the root of the fibers as shown by the dark arrows in FIG. 1. The high speed air jet stream R strongly blows downward on the water membranes 12 on the fibers 1*a* and on the water 12*a* between the fibers 1*a*, blows off the water membranes 12 on the fibers 1*a* downward, and flows together with the negative pressure zone at the sucking-out nozzle 3*c*. The high speed negative pressure air stream Q is accelerated by the multiplication effect of the high speed air jet stream R and the high speed negative pressure air stream Q, and transfers the water membranes 12 and water between the fibers 12*a* upward. Water membranes on the fibers 1*a* are divided into continuous water drops 13 by a dynamic pressure of the negative pressure air stream Q as shown in FIG. 17 and further into many minute water drops 14 as shown in FIG. 18. The water drops are sucked out on the high speed negative pressure air stream Q, and exhausted to the exterior to provide dehydrating and drying. Thus, the mat 1 is continuously dehydrated and dried.

In FIG. 16, if the flange 3*e* is not provided then the high speed air jet stream R takes a short cut along with the high speed negative pressure air stream Q as shown by the broken lines SO.

Minute water drops and water vapor sucked out on the high speed negative pressure air stream Q are sent into the water drop separating vessel 5. The cross sectional area of the water drop separating vessel 5 is remarkably wider than that of sucking-out pipe 3*a* as shown in FIG. 14, and the speed of the high speed negative pressure air stream Q decreases sharply in the water drop separating vessel 5. Therefore, water drops 14 fall from the air flow due to their own weight. Water A at the bottom of the vessel 5 is discharged to the exterior of the vessel using a positive-displacement pump 7A such as snake pump, Archimedes pump, monoflex pump, etc. Part of the water drops carried on the negative pressure air stream Q, (FIG. 14) and dust are filtered by the filter 8. Clean air $Q_2$ (FIG. 15) is input to the dehumidifier 6 to be dehumidified and output as dry air $Q_3$. The dehumidified air $Q_3$ is input to the inlet of the blower 4. Pressurized air flow $R_D$ (FIG. 19) is output from the blower 4 to the blowing nozzles 3*d*. A high speed air jet stream R is strongly output from the blowing nozzles 3*d* to the fibers 1*a* of the mat 1 to provide continuous dehydrating and drying. In the water drop separating vessel 5, a rotary valve 7B, as shown by broken lines in FIG. 14, may be used in place of the positive-displacement pump 7A to discharge the water to the exterior of the vessel 5 and to pool the discharged water into a container 10. In this case, inter-vessel pressure $P_T$ and atmospheric pressure $P_{OA}$ are constantly isolated by the action of the rotating rotary valve 7B and a sealing plate 7C at the circumference of the rotary valve 7B.

Figure 15:
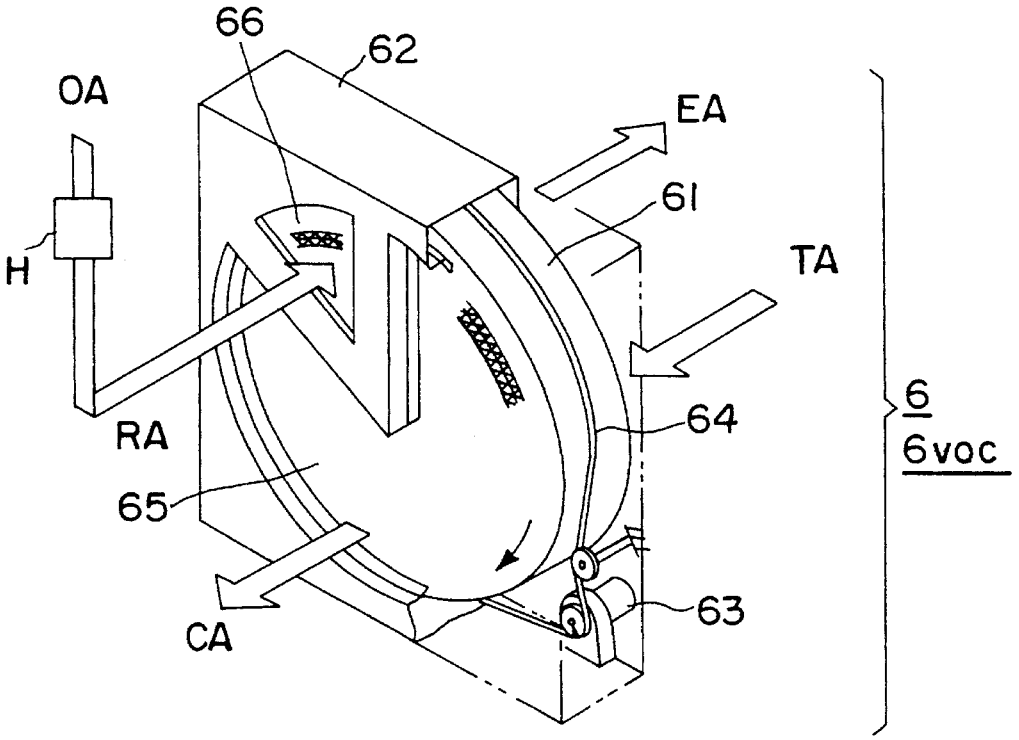
FIG. 15 is a perspective view of a dehumidifier using a honeycomb rotor, a portion being broken away for the purpose of illustration.

In the dehumidifier 6, as shown in FIG. 15, a honeycomb dehumidifier rotor 61, capable of humidity adsorption, is held rotatably in a casing 62 and is rotated by a motor 63 and a drive belt 64 at a speed of approximately 10–20 r.p.h. Humid air $Q_2$, from which water drops are separated in the water drop separating vessel 5 (FIG. 14), is input to a process zone 65 of the rotor 61 in the direction of the arrow by the blower 4 at the speed of approximately 1–3 m/sec. The moisture in the humid air $Q_2$ is adsorbed and removed by the honeycomb rotor 61 to obtain dry air $Q_3$, which is supplied to the blowing pipes 3*b* of the component 3 (FIG. 19) by the blower 4 to form the high speed air jet stream $R_D$ to accelerate drying. On the other hand, reactivation air RA, which is prepared by heating outer air OA up to approximately 100°–140° by the heater H, is passed through small channels of the reactivation zone 66 (shown by the arrow RA) in the opposite direction of the process air $Q_2$ to continuously desorb, by heating, the humidity adsorbed in absorbing zone 65 and to discharge it as exhaust air EA. Thus the absorbing zone 65 continuously supplies dry air $Q_3$ changed from process air $Q_2$ to the blowing pipes 3*b*.

Figure 19:
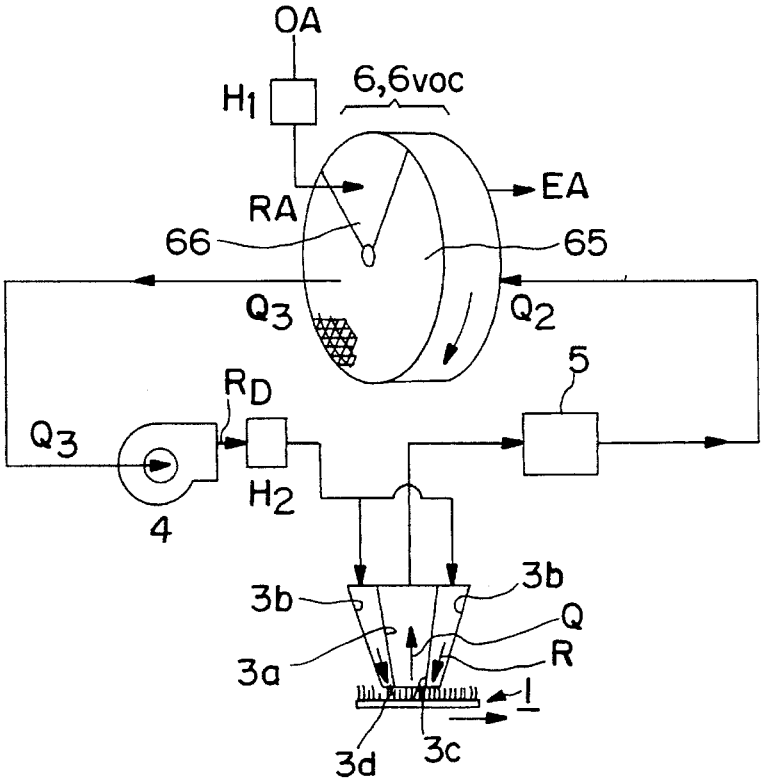
FIG. 19 is a cross section of a dehydrating and drying device according to the present invention when a blower is used.

A flow pattern of the case when a single blower is used is shown in FIG. 19. When the temperature of the dry air $Q_3$ from the dehumidifier is low, the dry air $Q_3$ is input to a blower 4 and then input a heater $H_2$ to heat the air to 40°–80° C. and to lower the air's relative humidity to obtain a high speed air jet stream R to blow against the mat 1 to promote drying.

Figure 20:
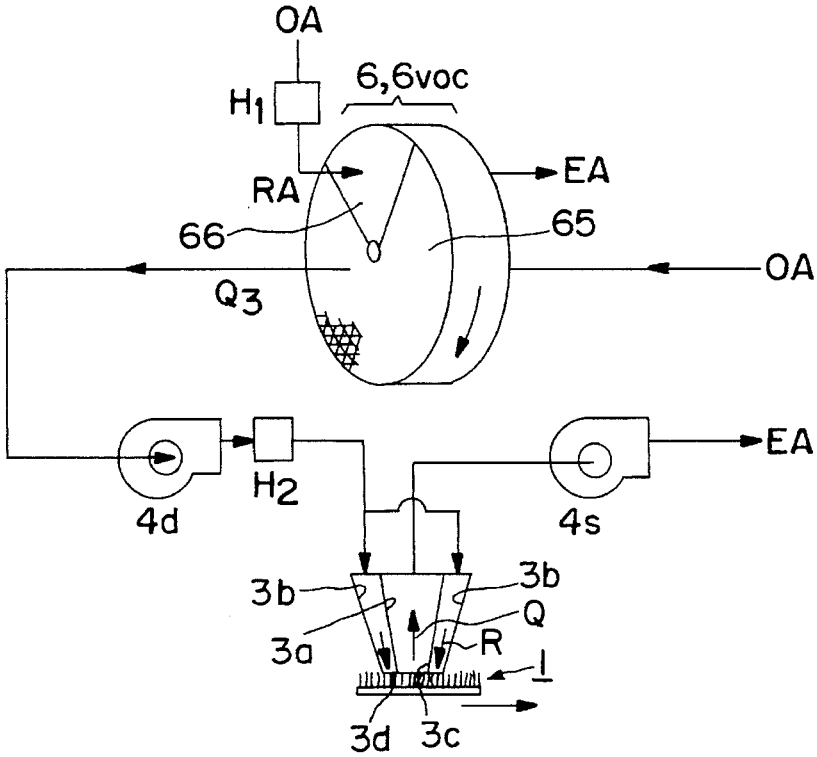
FIG. 20 is a cross section of a dehydrating and drying device according to the present invention when two blowers are used, one for blowing air and the other for sucking-out water drops.

FIG. 20 shows a flow pattern of a case when an air blowing blower 4*d*, a water drop sucking-out blower 4*s* and a dehumidifier 6 are used. The sucking-out blower 4*s* is connected to the sucking-out pipe 3*a* of the component 3. Exhaust air EA containing water drops that were sucked out by the blower 4*s* is exhausted into the outer air OA.

A rotary dehumidifier 6 is placed in the pre-stage of the inlet of the blower 4*d*. The outlet of the blower 4*d* and the blowing pipes 3*b* of the component 3 are connected via the heater $H_2$. Outer air OA is input to the dehumidifying zone of the dehumidifier 6 to remove humidity in the outer air OA. The outer air OA is pressurized by the blower 4*d*, is heated by the heater $H_2$ and a dry high speed air jet stream R from the heater $H_2$ is strongly blown into the wet mat 1 from the blowing nozzles 3*d* to speedily dry the mat 1. In this case, the time for drying can be shortened approximately 40% compared with the case when the dehumidifier 6 is not provided.

When the mat 1 to be dried is wet after being washed with a volatile liquid other than water, a volatile liquid vapor (VOC) adsorbing and removing device 6 voc instead of the dehumidifier 6 is used as shown in FIGS. 19 and 20.

In this case, a honeycomb rotary type adsorbing and removing device is used, for example, as the adsorbing and removing device, and a honeycomb rotor carrying active carbon, hydrophobic zeolite, etc., as adsorbent is used. The honeycomb rotary type adsorbing and removing device 6voc, like the dehumidifier 6 shown in FIG. 15, has a VOC adsorbing zone 65 and a VOC desorbing zone 66. It continuously adsorbs VOC in the air $Q_2$ (FIG. 19) from the gas-liquid separating vessel 5 (FIG. 14) to obtain clean air $Q_3$. The clean air $Q_3$ is used as an air jet stream R to continuously dry the mat 1. The blower 4 is operated and organic solvent in the wet mat 1 is sucked out by the sucking-out nozzle 3*c* of the component 3 as shown in FIG. 19. Air is passed in a gas-liquid separating vessel 5, air containing organic solvent vapor(s) is input to the adsorbing zone 65 of the honeycomb rotary type adsorbing and removing device and clean air $Q_3$ which has the organic solvent vapor(s) removed is sucked into an inlet of a blower 4 and pressurized and heated by heater $H_2$. The air is strongly blown onto the wet mat 1 as a high speed air jet stream R from the blowing nozzles 3*d* of the component 3 to dry the wet mat 1. In this honeycomb rotary type adsorbing and removing device 6voc, outer air OA is heated to approximately 120°–180° C. and input to its reactivation zone as reactivation air RA. Concentrated VOC adsorbed at the adsorbing zone 65 becomes an exhaust air, and is discharged into the outer air OA.

In the case of drying a mat 1 washed with a mixture of a volatile liquid and water, a honeycomb adsorbing and removing device using a rotary type VOC adsorbing and removing element containing an adsorbent which removes water such as hydrophilic zeolite and hydrophobic zeolite may be used.

A component 3 has been shown in which a sucking-out nozzle 3*c* and a blowing nozzle 3*d* are adjacent each other as shown in FIGS. 1 and 2. However, a component comprising a sucking-out pipe 3*a* containing a sucking-out nozzle 3*c* with a built-in blowing pipe 3*b* containing a blowing nozzle 3*d* or a component comprising a blowing pipe 3*b* containing a blowing nozzle 3*d* with a built-in sucking-out pipe 3*a* containing a sucking-out nozzle 3*c* can be used to achieve approximately the same action and effects.

Figure 21:
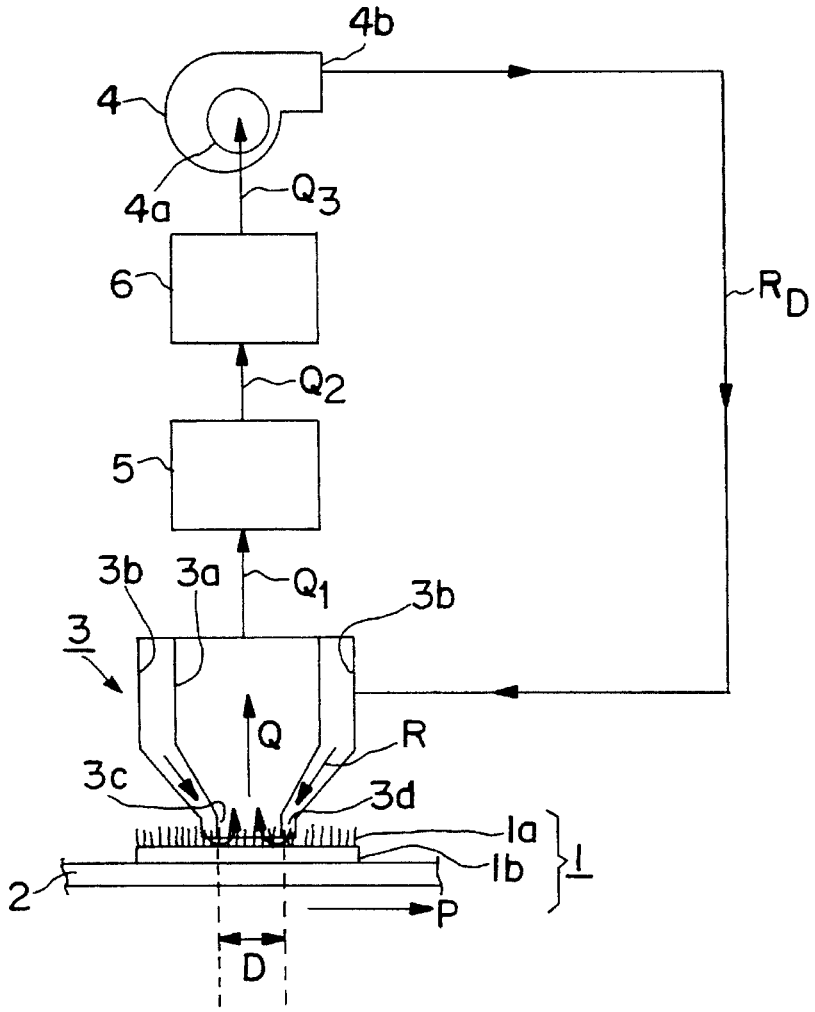
FIG. 21 is a cross section of a dehydrating and drying device using a sucking-out nozzle and a blowing nozzle, both without a flange.
Figure 22:
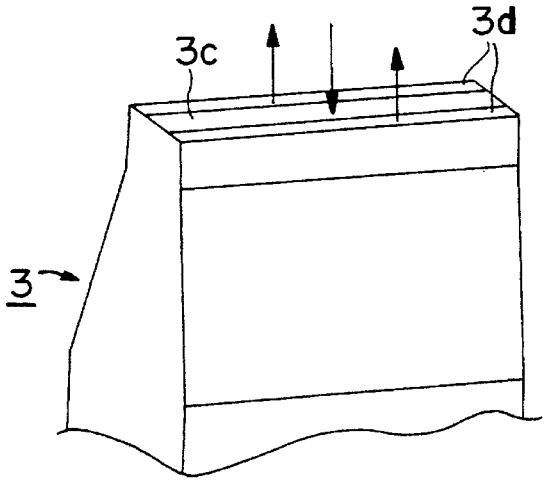
FIG. 22 is a perspective view of a component used in FIG. 21 in the dehydrating and drying device according to the present invention.
Figure 23:
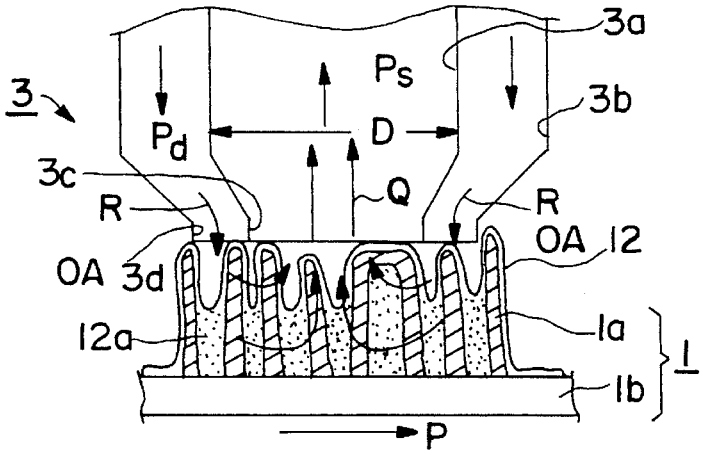
FIG. 23 is a cross section of a mat whose fibers are coated with membranes of water contacting a component without a flange.
Figure 24:
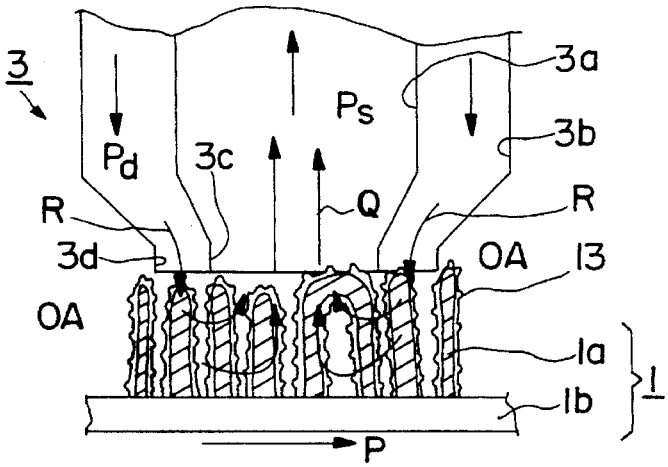
FIG. 24 is a cross section of a mat whose fibers are covered with continuous drops of water by the negative pressure air stream and the air jet stream from the component without a flange.
Figure 25:
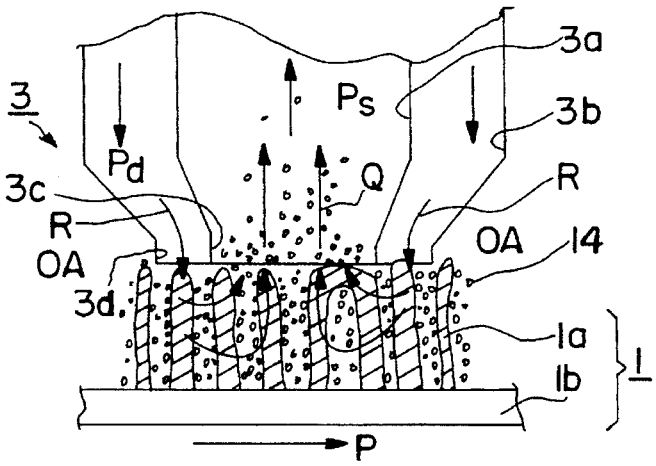
FIG. 25 is a cross section of a mat in which minute water drops are produced on the fibers of the mat by the negative pressure air stream and air jet stream from the component without a flange.

FIGS. 21 and 22 show a dehydrating and drying device using a sucking-out nozzle 3*c* and blowing nozzles 3*d* , both without flanges. The actions of a high speed air jet stream R and a high speed negative pressure air stream Q in the component 3 are shown in FIGS. 23, 24 and 25. Water membranes 12 on the fibers 1*a* of the mat 1 and water 12*a* at the gaps of the fibers 1*a* shown in FIG. 23 gradually become continuous water drops 13 as shown in FIG. 24 and change to many minute water drops 14 as shown in FIG. 25. The action of the high speed air jet stream R and high speed negative pressure air stream Q when flanges are provided are described in detail in FIGS. 16, 17 and 18. When flanges are not provided, the high speed air jet stream R and high speed negative pressure air stream Q take a short cut at the tips of the nozzles 3a, 3b , 3c and 3d. Also, both streams and the outer air are short cut at the tips of the nozzles 3a, 3b, 3c and 3d. Thus, only a small amount of the high speed air jet stream R and a small amount of the high speed negative pressure air stream Q can reach the roots of the fibers 1a. This decreases the efficiency of drying compared with the case when flanges are provided.

Figure 26:
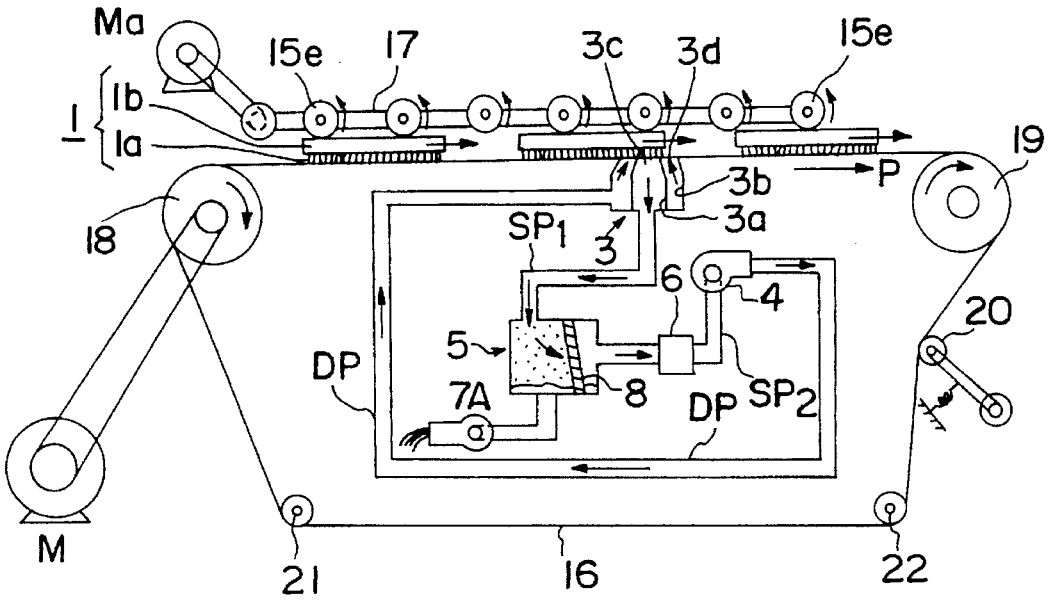
FIG. 26 is a sectional view of another embodiment of a dehydrating and drying device according to the present invention.
Figure 27:
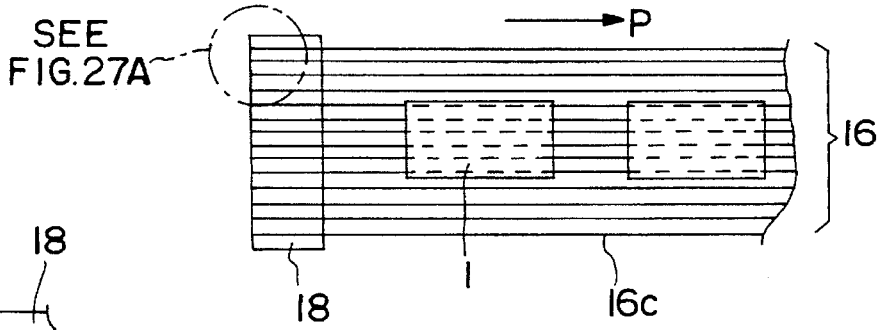
FIG. 27 is a plan view of a wire endless conveyor used in FIG. 26.
Figure 27A:
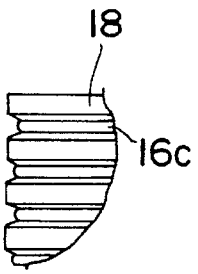
Figure 28:
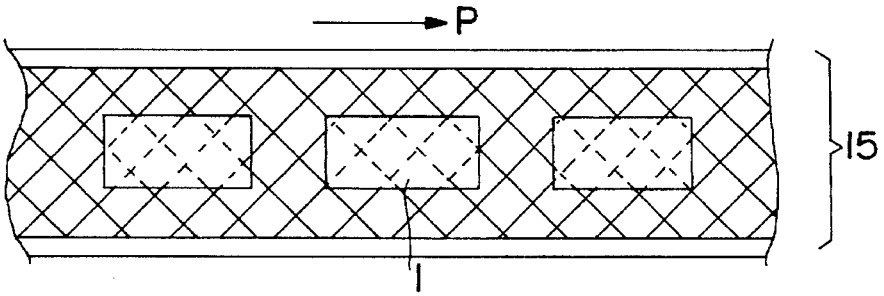
FIG. 28 is a plan view of a net-type endless conveyor used in FIG. 26.

As shown in FIG. 26, a rapid dehydrating and drying device usable in low temperature comprises a wire endless conveyor 16 installed among a driving pulley 18, a driven pulley 19, a tension pulley 20 and driven pulleys 21 and 22. A component 3 is formed with a sucking-out nozzle 3c and blowing nozzles 3d , provided in one body and is placed under the conveyor 16. As shown in FIG. 27, the conveyor 16 is an endless conveyor with many wires 16c placed at appropriate intervals. Grooves are provided on the driving pulley 18 and the driven pulley 19 at the same intervals as the intervals between the wires so that the wires can fit onto the driving pulley 18 and the driven pulley 19. Instead of using the wire endless conveyor 16, a net-type endless conveyor 15 having a large opening ratio having a mesh of 10 mm by 10 mm as shown in FIG. 28 may be used.

In FIG. 26, the sucking-out nozzle 3c is connected to the inlet of the water drop separating vessel 5 by a duct $Sp_1$, blowing nozzles 3d are connected to the outlet of the blower 4 by a duct Dp, and the outlet of the water drop separating vessel 5 and the inlet 4a of the blower 4 are connected by a duct $Sp_2$ via the dehumidifier 6. Plural pressing rollers 15e are placed at positions to press down the article to be dried, e.g., mat 1, to prevent the mat 1 from rising by the strong air jet stream from the blowing nozzles 3d of the component 3. Plural pressing rollers 15e are connected together by chains 17.

The action of this embodiment shown in FIG. 26 will be explained. A mat 1 is placed with its fibers 1a side down between the conveyor 16 and the pressing rollers 15e. The conveyor 16 and pressing rollers 15e are moved by motors M and Ma in the direction of the arrow P at a speed of 6–10 mm/sec. The jet stream blows strongly from the blowing nozzles 3d at fibers 1a of the mat 1 by the action of the blower 4, so that the stream goes into fibers 1a of the mat 1. Water drops and water in the fibers 1a of the mat 1 are intensely and speedily sucked out from the sucking-out nozzle 3c by the high speed negative pressure air stream Q accelerated by the multiplication effect of the air jet stream R and negative pressure air stream Q at the sucking-out nozzle 3c, to provide continuous drying. In this case, static pressure in the sucking-out nozzle 3c is approximately −800—1500 mmAq and static pressure in the blowing nozzle 3c is approximately +800–+1500 mmAq.

The component 3 used in this example is the component as shown in FIG. 22. The component 3 is a component without flanges to prevent the short cut of air flow. When a component with flanges as shown in FIG. 1 is used, drying time is decreased and the energy saving effect is greater than in the case of using a component without flanges.

In the present embodiment, a component in which a sucking-out nozzle 3c and blowing nozzle 3d are formed in one body is used. The sucking-out nozzles 3c and the blowing nozzle 3d may be separately and closely arranged.

Figure 29:
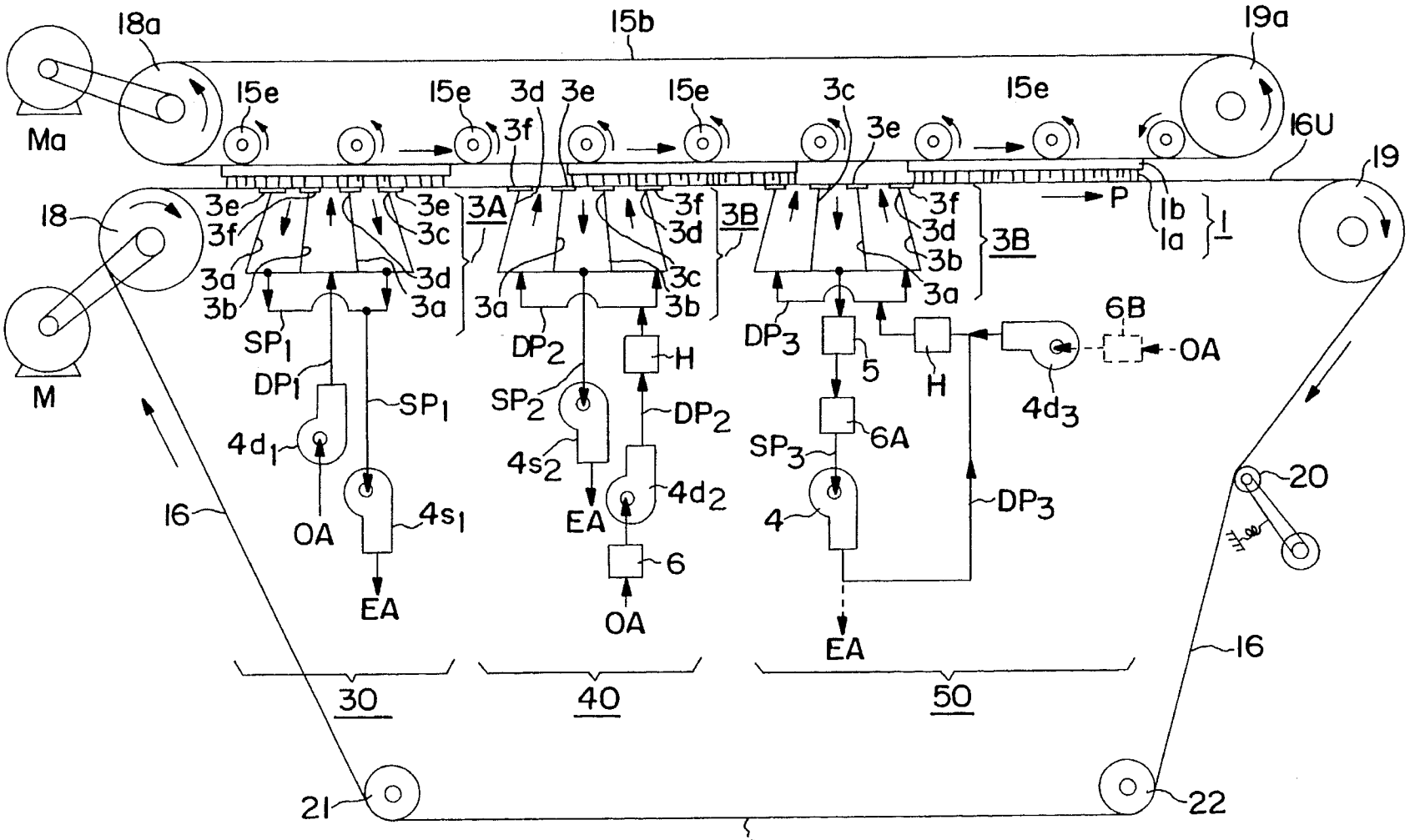
FIG. 29 is a sectional view of a three stage dehydrating and drying device according to the present invention.

As shown in FIG. 29, a wire endless conveyor 16, is driven in the direction shown by the arrow P as in FIG. 26. The belt conveyor 15b is driven by a driving motor Ma via a driving pulley 18a at the same speed as the conveyor 16 in the direction shown by the arrow. The mat 1 is between the conveyor 16 and the belt conveyor 15b. Plural rollers 15e are on the reverse side of the belt conveyor 15b and press an article to be dried.

The first dehydrating device 30 comprises a component 3 including two sucking-out nozzles 3c and one blowing nozzle 3d. Both the sucking-out nozzles 3c and the blowing nozzle 3d are provided with flanges 3e, 3f and 3h (see FIG. 2). The two sucking-out nozzles 3c are located at both sides of the blowing nozzle 3d and combined as shown in the drawing. A sucking-out blower $4s_1$ has an inlet connected with the sucking-out nozzles 3c by a duct $Sp_1$. A blowing blower $4d_1$ has an outlet connected with the blowing nozzle 3d by a duct $Dp_1$.

The second drying device 40 includes a component 3B as shown in FIG. 2, a blowing blower $4d_2$ having an outlet connected with the blowing nozzles 3d of the component 3B by a duct $DP_2$ and via a heater H. A dehumidifier 6 is located at the front of the inlet of the blower $4d_2$. A sucking-out blower $4s_2$ has an inlet connected to the sucking-out nozzle 3c by a duct $SP_2$.

The third drying device 50 uses the component 3B used in the second drying device 40. The inlet of a blower 4 is connected to the sucking-out nozzle 3c of the component 3B by a duct $SP_3$ via a water drop separating vessel 5 and a dehumidifier 6A. The outlet of the blower 4 is connected to the blowing nozzles 3d of the component 3B by a duct $DP_3$ via a heater H.

The operation of the device shown in FIG. 29 will now be explained. A driving pulley 18 of the wire endless conveyor 16 and a driving pulley 18a of the belt conveyor 15b are driven to move both conveyors 15b and 16 at the same speed in the direction P as shown in the drawing. Mat 1 is kept between the conveyors 15b and 16 with its fibers 1a set downward, to provide dehydrating and drying.

In the first dehydrating device 30, the blowing blower $4d_1$ and the sucking-out blower $4s_1$ are operated, a high speed negative pressure air stream is accelerated by the multiplication effect of the high speed air jet stream and the high speed negative pressure air stream, water on the fibers of the mat 1 is sucked out as minute water drops by the sucking-out nozzles 3c, and the air stream is exhausted from the sucking-out blower $4s_1$ to continuously dehydrate the mat 1. In this case, the static pressure in the sucking-out nozzle 3c of the component 3A is as high as approximately −1300 mmAq, and the static pressure in the blowing nozzle is approximately +500–+800 mmAq to remove approximately 70–86% of the maximum water content.

Then, the mat 1, dehydrated at the first dehydrating device 30, is transferred between conveyors 15b and 16 and is dried by a component 3B of the second drying device 40. In the second drying device 40, humidity in the outer air is removed by the dehumidifier 6, dried air is heated to approximately 60° C. by the heater H, and the air is blown into the roots of the fibers 1a of the mat 1 as a hot and dry high speed air jet stream from the blowing nozzles 3d to provide drying. The water remaining after the dehydration in the first stage is removed. The ratio of removed water is approximately 86%–90%. In this case, the static pressure in the sucking-out nozzle 3c is approximately −500—800 mmAq and the static pressure in the blowing nozzle 3d is as high as +1300 mmAq.

The mat 1 is then conveyed to the third drying device 50. In the third drying device 50 a hot and low-humidity high speed air jet stream is blown into the fibers 1a of the mat 1 by the action of a blower 4, and the remaining water is quickly sucked out by the sucking-out nozzle 3c of the component 3B. The water drops and dust in the air stream are removed at the water drop separating vessel 5, the air stream is dried to a dew point of approximately −20° C. to −50° C. by the dehumidifier 6A, dried air is input to the heater H from the outlet of the blower 4 and heated to approximately 80° C., the air is again blown strongly into the fibers 1*a* of the mat 1 as a hot and low-humidity high speed air jet stream from blowing nozzles 3*d* and the high speed air jet stream is accelerated to remove a very small quantity of water remaining in the fibers 1*a* to complete the third drying operation. During the third drying operation approximately 90–95% of the water contained in the mat 1 is removed. In this case, the static pressure in the sucking-out nozzle 3*c* is approximately −700 mmAq and the static pressure in the blowing nozzle is approximately +1500 mmAq. An absolute drying of approximately 100% can be achieved by regulating the static pressures in the sucking-out nozzle and in the blowing nozzle 3*d* in each component 3 as described above. This results in a great energy saving.

In the third drying device 50, a blower for circulating air flow is used. A sucking-out blower 4 may be used and a blowing blower $4d_3$ may be used as shown by the broken lines in the drawing. In this case, the sucked-out air may be discharged as an exhaust air EA from the outlet of the sucking-out blower 4. Outer air OA may be dehumidified by a dehumidifier 6B arranged at the front of the inlet of the blowing blower $4d_3$, as shown by the dotted lines. The resulting dry air may also be heated by the heater H to act on both blowing nozzles 3*d*. In this case the dehumidifier 6A is not necessary.

Figure 30:
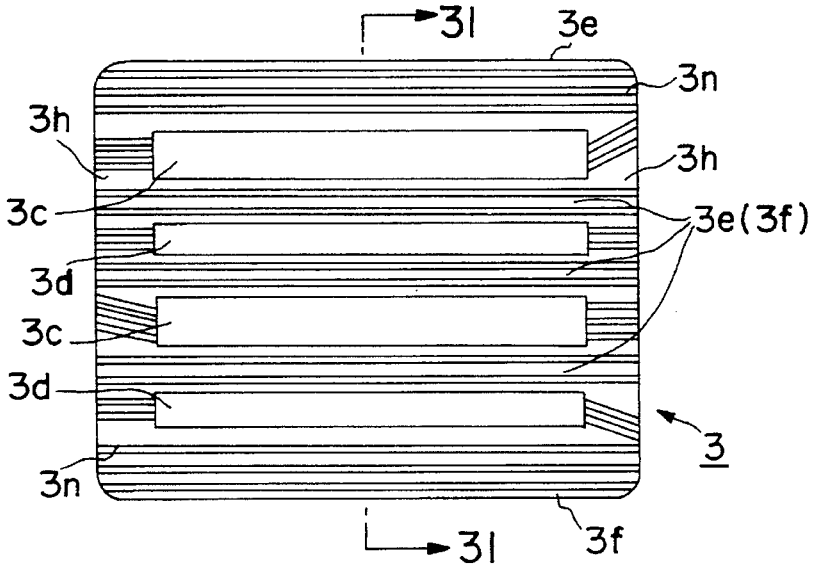
FIG. 30 is a plan view showing a modification of the component used in FIG. 29 of the present invention.
Figure 31:
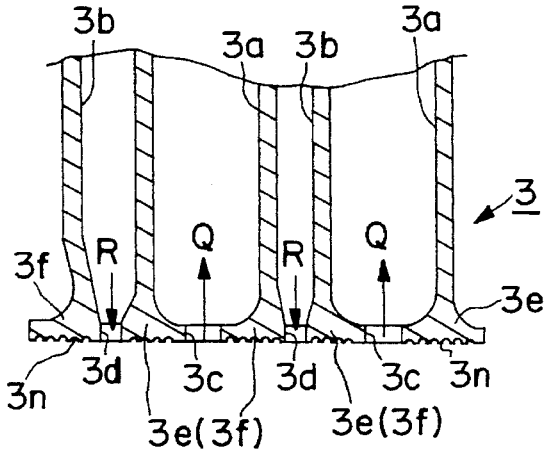
FIG. 31 is a sectional view taken along the line C—C in FIG. 30.
Figure 32:
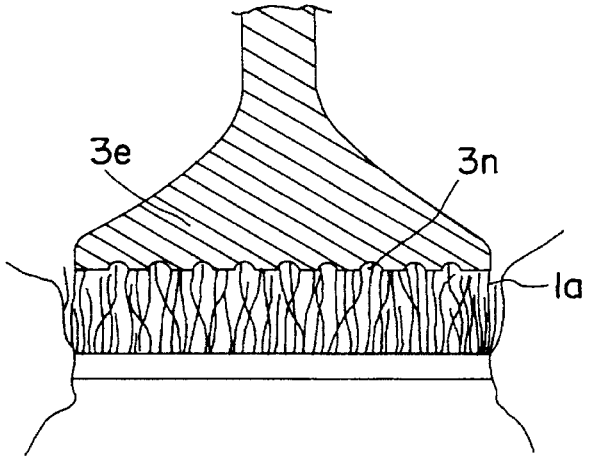
FIG. 32 is a partially enlarged view of FIG. 31.

Another modified example of the component 3 used in the present invention is shown in FIGS. 30, 31 and 32. FIG. 30 shows a component 3 having sucking-out nozzles 3*c* and blowing nozzles 3*d*, alternately arranged. FIG. 31 is a cross sectional view of FIG. 30 taken along the line C—C. Each sucking-out nozzle 3*c* and each blowing nozzle 3*d* are provided with flanges 3*e*, 3*f* and 3*h* at their circumferences and grooves 3*n* are provided on the plane of the flanges. An article to be dried is slid in the direction crossing the air flow. Thus, as shown in FIG. 32, the tips of fibers 1*a* of the mat 1 penetrate into the grooves 3*n* to increase the resistance of air flow. The nozzle surface is also pressed strongly to the mat surface and deviation of the high speed air streams can be prevented by the grooves 3*n*.

Figure 33:
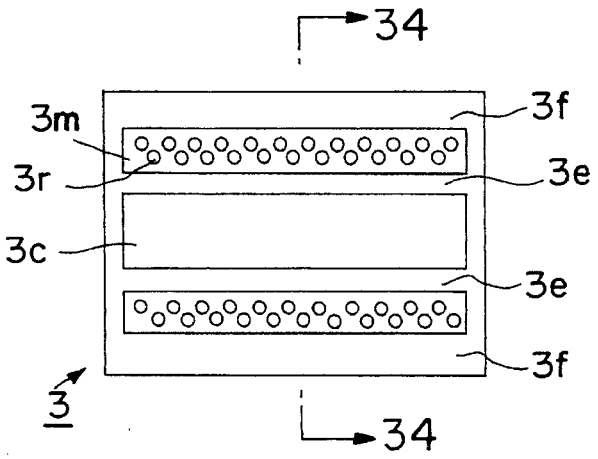
FIG. 33 is a plan view showing a modification of the component used in FIG. 29 of the present invention.
Figure 34:
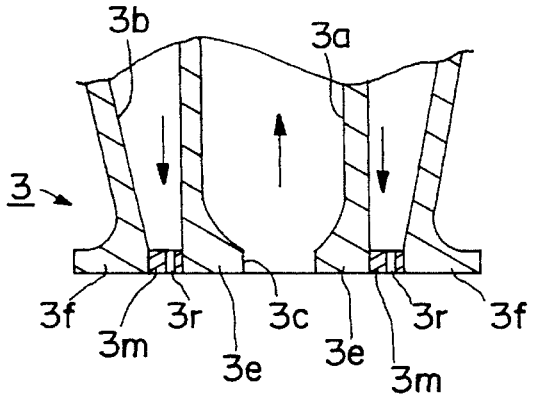
FIG. 34 is a sectional view taken along the line D—D in FIG. 33.
Figure 35:
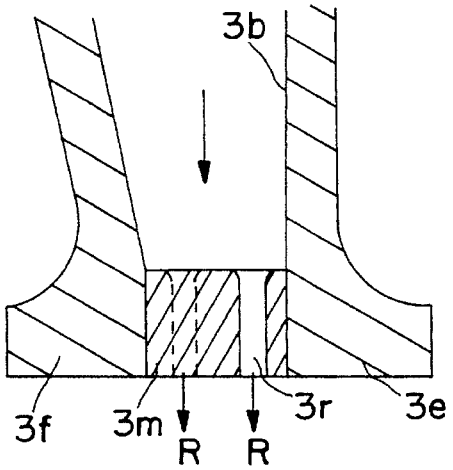
FIG. 35 is an enlarged view of a portion of FIG. 34.

FIGS. 33, 34 and 35 show another example of the component 3. FIG. 33 is a plan view of the component 3, FIG. 34 is a cross sectional view of FIG. 33 taken along the line D—D, and FIG. 35 is an enlarged view of FIG. 34. A plate 3*m* having many small holes 3*r* arranged in a zigzag configuration is attached at the tip of an opening of blowing pipes 3*b* adjacent to both sides of the sucking-out pipe 3*a*. Thus, the small holes 3*r* act as separate blowing nozzles. A high speed air jet stream R is blown out intermittently from the small holes 3*r* and the jet stream easily penetrates into minute gaps in the fibers 1*a* of the mat 1.

Figure 36:
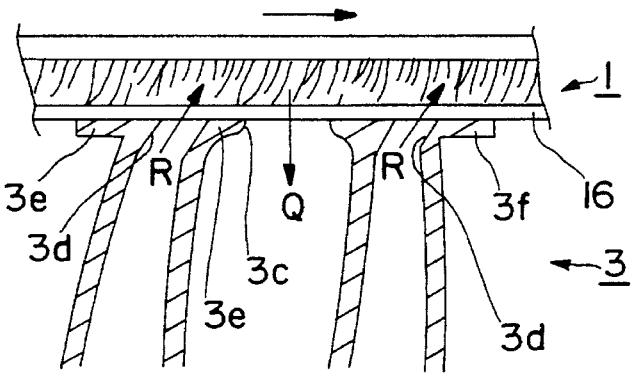
FIG. 36 is a vertical sectional view showing a modified component used in FIG. 29 according to the present invention.
Figure 37:
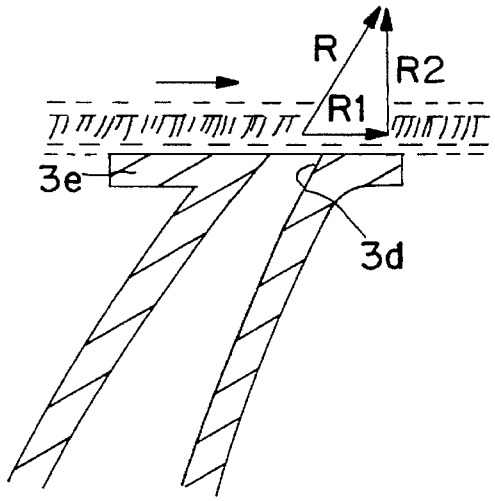
FIG. 37 is an enlarged view of a blowing nozzle shown in FIG. 36 explained by deconstructing the vector R of jet stream into vectors $R_1$ and $R_2$.
Figure 38:
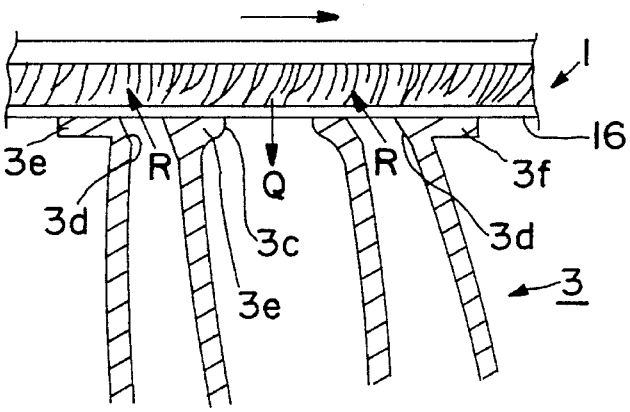
FIG. 38 is a vertical sectional view of another modified component used in FIG. 29 according to the present invention.

In FIGS. 33, 34 and 35, the blowing nozzle 3*d* is constructed such that the high speed air jet stream R gushes out perpendicular to the article to be dried. As shown in FIG. 36, the blowing nozzle 3*d* may be constructed such that the high speed air jet stream R gushes out obliquely to the conveying direction of the article to be dried. As shown by the vector in FIG. 37, which is an enlarged view of FIG. 36, the force of the high speed air jet stream R can be considered as a component of the force $R_1$ to the direction of conveying the article to be dried and a component of force $R_2$ perpendicular to $R_1$. The component of the force $R_1$ contributes to transferring the article to be dried along the wire endless conveyor 16 to conserve energy. In contrast, if the blowing nozzle 3*d* is constructed such that the high speed jet stream R gushes out obliquely in a direction opposite to the transferring direction of the article to be dried as shown in FIG. 38, dehydrating and drying efficiency increases compared with the case when the high speed air jet stream gushes out perpendicular to the article to be dried.

Figure 39:
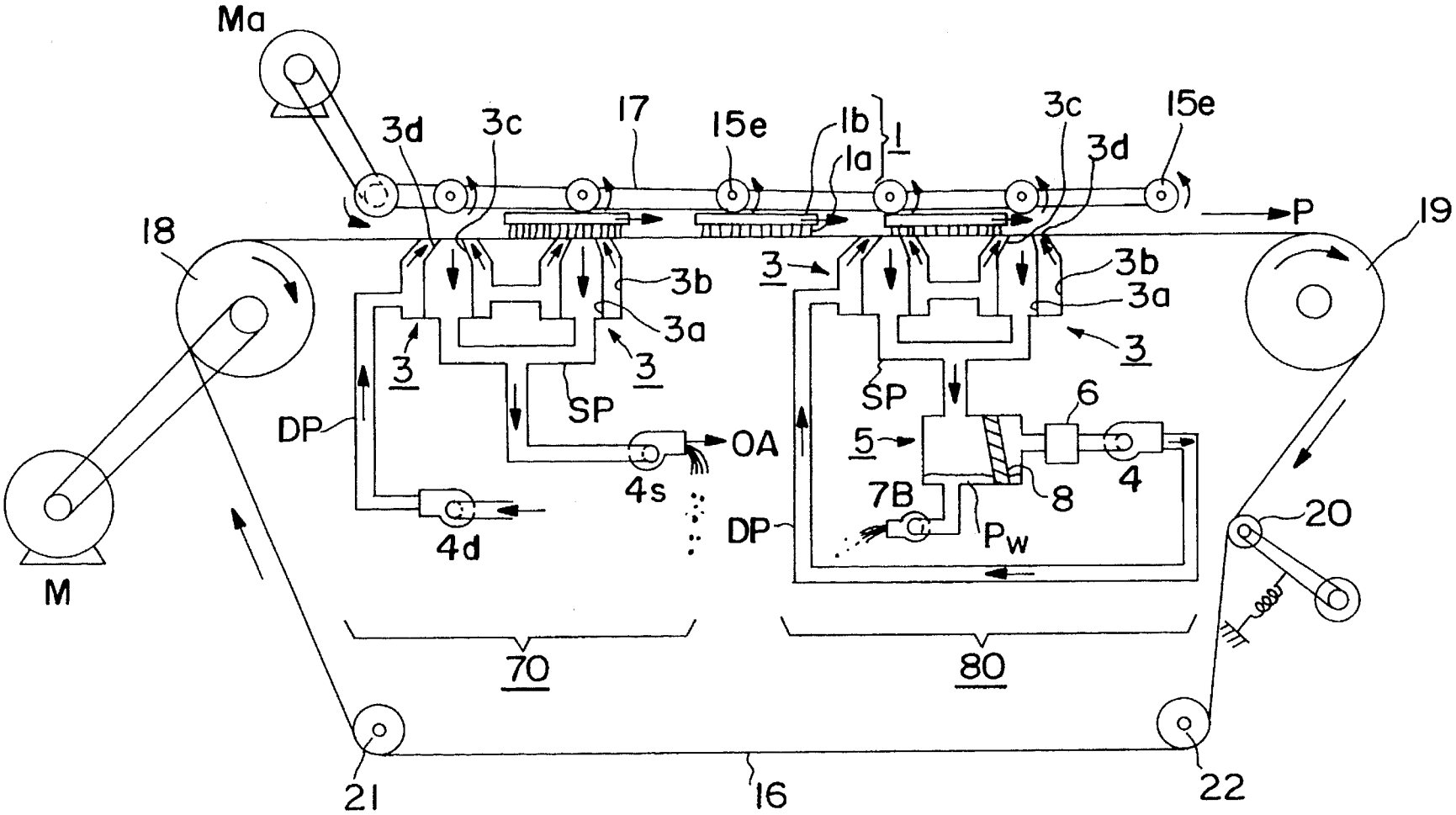
FIG. 39 is a sectional view of a dehydrating and drying device of another embodiment according to the present invention.

A modified embodiment of the dehydrating and drying device according to the present invention is shown in FIG. 39. The wet mat 1 is transferred between the wire endless conveyor 16 and pressing rollers 15*e*. The mat 1 is dehydrated and dried by a pre-stage dehydrating device 70 including two components 3 having a sucking-out nozzle 3*c* and blowing nozzles 3*d* both without flanges and by a post-stage drying device 80 including two components 3 the same as those in the pre-stage dehydrating device 70. In this case, a blower 4*s* for sucking-out and a blower 4*d* for blowing are used in the pre-stage dehydrating device 70 to increase the dehydrating efficiency. In the post-stage dehydrating device 80 blower 4 is used for circulating the air. A water drop separating vessel 5 and a dehumidifier 6 are arranged in front of the blower 4 in the post-stage drying device 80 to increase the drying efficiency.

A component 3 including one or more sucking-out nozzle(s) 3*c* and one or more blowing nozzle(s) 3*d* may be used according to the materials, sizes, thicknesses, etc., of the articles to be dried. Also, plural components 3 may be used to dehydrate and dry in plural stages. In this case, two blowers, one for sucking-out and one for blowing, may be used, or a blower for circulating may be used. Static pressures in the sucking-out nozzle 3*c* and in the blowing nozzle 3*d* may be controlled at will.

Figure 40:
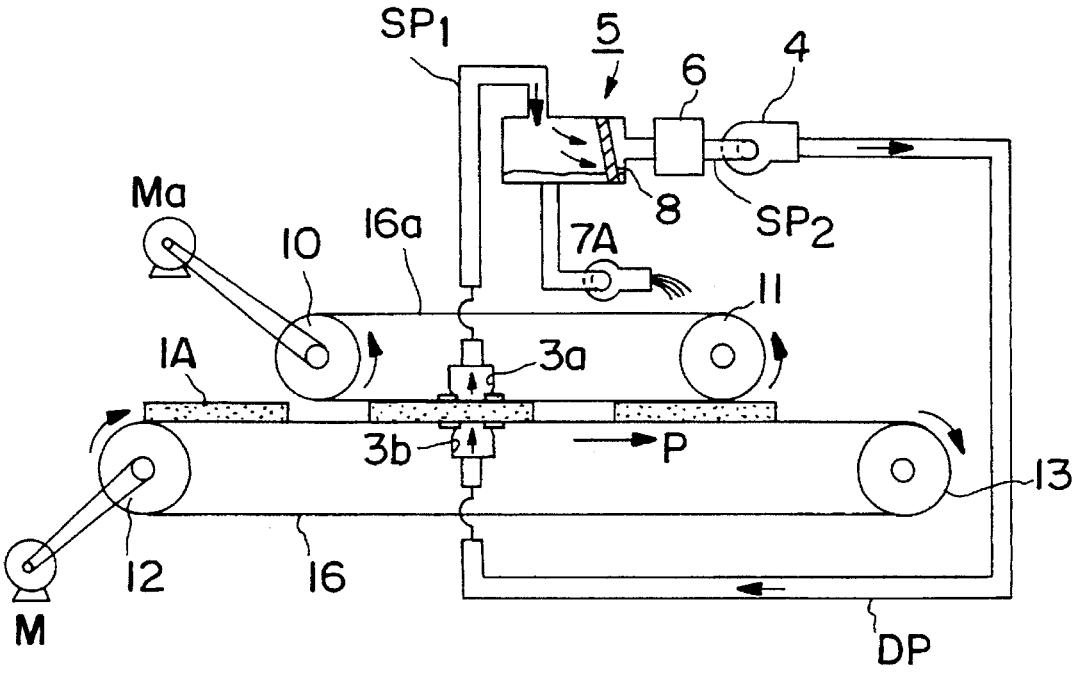
FIG. 40 is a sectional view of a dehydrating and drying device of yet another embodiment according to the present invention.

Referring to FIG. 40, an embodiment of the present invention for drying an article such as a carpet through which air can pass in the direction of its thickness is described. A wire endless conveyor 16*a* is installed among a driving pulley 10 and a driven pulley 11. A wire endless conveyor 16 is installed among a driving pulley 12 and a driven pulley 13. An article to be dried such as a wet carpet 1A is held between the lower part of the conveyor 16a and the upper part of the conveyor 16, and is carried in the direction shown by the arrow P.

Figure 41:
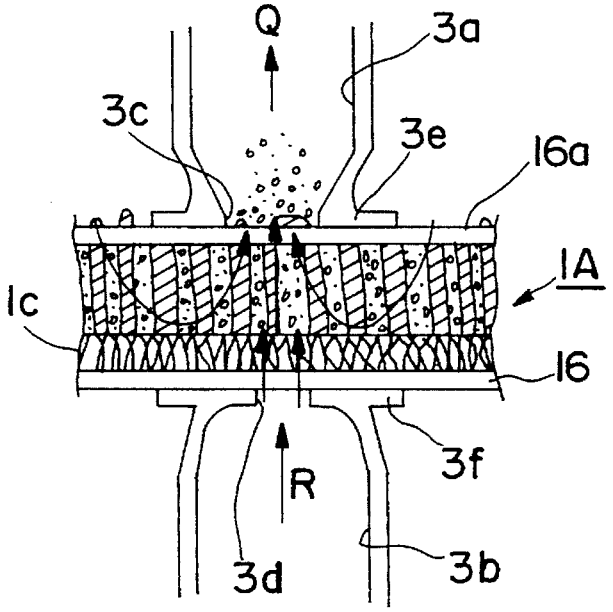
FIG. 41 is an enlarged view of a part of a component to dehydrate and dry an article shown in FIG. 40.

As shown in FIG. 41, a sucking-out nozzle 3*c* having a flange 3*e* in its circumferential part and a blowing nozzle 3*d* having a flange 3*f* in its circumferential part are arranged opposite each other at a position where they touch and slide on the surfaces of an article to be dried 1A. The conveyors 16*a* and 16 are located therebetween.

The sucking-out nozzle 3*c* is connected to the inlet of the water drop separating vessel 5 by a duct $Sp_1$. The outlet of the water drop separating vessel 5 and the inlet of the blower 4 are connected by a duct $Sp_2$ via a dehumidifier 6. The outlet of the blower 4 and the blowing nozzle 3*d* are connected by a duct Dp.

The action of the embodiment in FIG. 40 is now explained. The conveyors 16 and 16*a* are driven at the same speed by motors M and Ma. An air-permeable wet carpet 1A is placed on the conveyor 16 and is moved in the direction shown by the arrow P at a speed of approximately 5–50 mm/sec. The carpet 1A, held between the two conveyors 16 and 16*a*, is carried to a position where the sucking-out nozzle 3*c* and the blowing nozzle 3*d* are in counter positions.

As shown in FIG. 41, when the blower 4 is operated, the high speed air jet stream R gushes out from the high speed jet blowing nozzle 3*d* which is placed so that it touches and slides on the lower surface of the upper part of the conveyor 16. The high speed air jet stream R changes water contained in the carpet 1A into water drops and forces the water drops and water vapor upward to the top of the carpet 1A. The high speed air jet stream R flows into the negative pressure air stream region, and water drops and water vapor are sucked out from the sucking-out nozzle 3*c* by the high speed negative pressure air stream Q.

Air containing minute water drops are input to the water drop separating vessel 5. The air from which water drops and dust have been removed is input to the dehumidifier 6. The obtained dry air is input again to the blowing nozzle 3*d* by the blower 4. Continuous drying can be performed by continuing the above operation.

Figure 42:
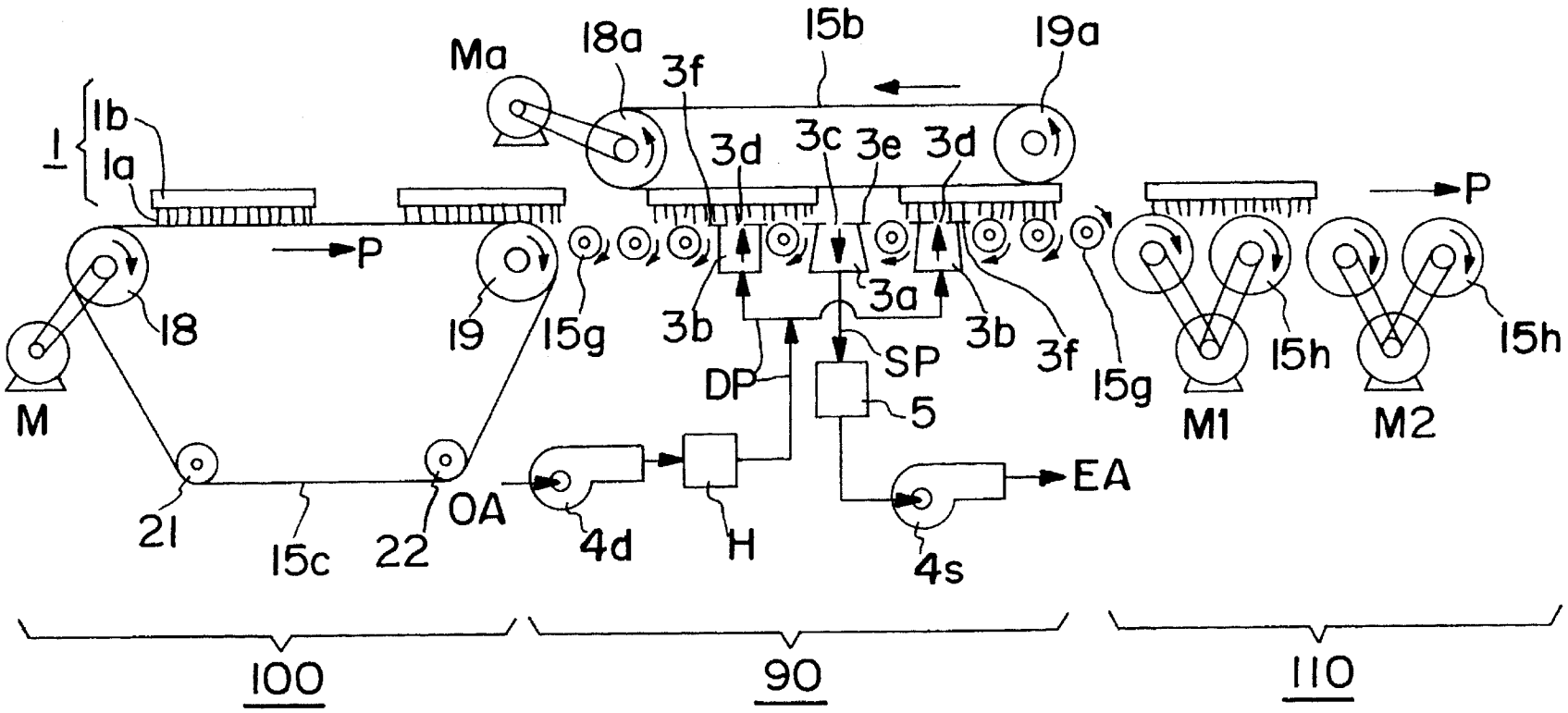
FIG. 42 is a sectional view according to the present invention.

FIG. 42 shows another embodiment of the present invention which includes a pre-stage conveying apparatus 100 and a post-stage conveying apparatus 110. Both apparatuses convey a mat 1 as an article to be dried. A dehydrating and drying part 90 is also provided. The pre-stage conveying apparatus 100 comprises a driving pulley 18, driven pulleys 19, 21 and 22, and an endless conveyor 15*c* coupled to the driving pulley 18 and the driven pulleys 19, 21 and 22. The post-stage conveying apparatus 110 comprises plural driving rollers 15*h* for conveying the article to be dried. The dehydrating and drying part 90 comprises an endless conveyor belt 15*b*, rollers 15*g* to hold and convey the mat 1, blowing nozzles 3*d* and a sucking-out nozzle 3*c*. The blowing and sucking-out nozzles 3*d* and 3*c*, respectively have flanges 3*e* and 3*f* at the circumference of tips inserted between the conveying rollers 15*g* and are placed at positions to contact and slide on the surface of fibers 1*a* of the mat 1. An outlet of a blowing blower 4*d* and the blowing nozzles 3*d* are connected by a duct Dp via a heater H. An inlet of sucking-out blower 4*s* and the sucking-out nozzle 3*c* are connected by a duct Sp via a water drop separating vessel 5.

A mat 1 is placed on the conveyor 15*c* of the pre-stage conveying apparatus 100 so that the fibers 1*a* of the mat 1 face downward, the driving pulley 18 is driven by a driving motor M to move the conveyor 15*c* in the direction shown by the arrow P to convey the mat 1 to the dehydrating and drying part 90. The mat 1 is dehydrated and dried as shown in FIG. 40 at the dehydrating and drying part 90 by the action of blowing nozzles 3*d* and a sucking-out nozzle 3*c*. Thereafter, the dehydrated and dried mat 1 is conveyed in the direction shown by the arrow P to the post-stage conveying apparatus 110 by driving rollers 15*h* for conveying the article to be dried, to complete the dehydrating and drying process. In this case, driving rollers 15*h* for conveying the article to be dried are driven by driving motors $M_1$, $M_2$ . . . .

In the post-stage conveying apparatus 110, an endless conveyor may be used instead of driving rollers 15*h* for conveying.

In the present embodiment shown in FIG. 42, two blowing nozzles 3*c* and a sucking-out nozzle 3*d* are arranged between conveying rollers 15*g*. The number and arrangement of the nozzles may be selected at will according to the sizes and kinds of article to be dried.

The dehydrating and drying method according to the present invention provides dehydrating and drying by employing a multiplication effect due to a combination of a high speed air jet stream and a high speed negative pressure air stream in accordance with a novel concept and principle. The present invention dehydrates and dries an article by changing the water contained in the article to be dried into minute water drops by the dynamic pressure of the high speed air jet stream R and the sucking force of the negative pressure air stream Q, with little vaporization heat energy of the water. The dehydration and drying occurs with less energy, less time, and at a lower temperature than prior art devices and without injuring the article to be dried.

Figure 43:
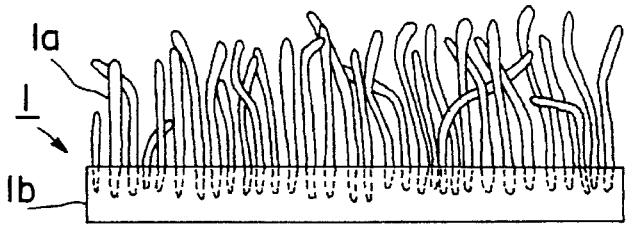
FIG. 43 is an enlarged sectional view of a mat.

A method of drying an implanted mat with a rubber sheet lining is described with respect to FIG. 43. This type of mat is the most difficult type of article to dry.

Figure 8:
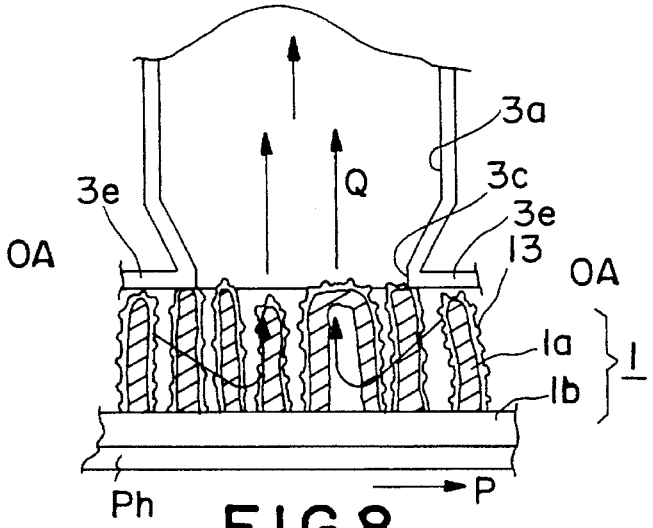
FIG. 8 is an enlarged cross section of surfaces of fibers of a mat covered with continuous water drops due to the negative pressure air stream from a sucking-out nozzle having flanges.
Figure 9:
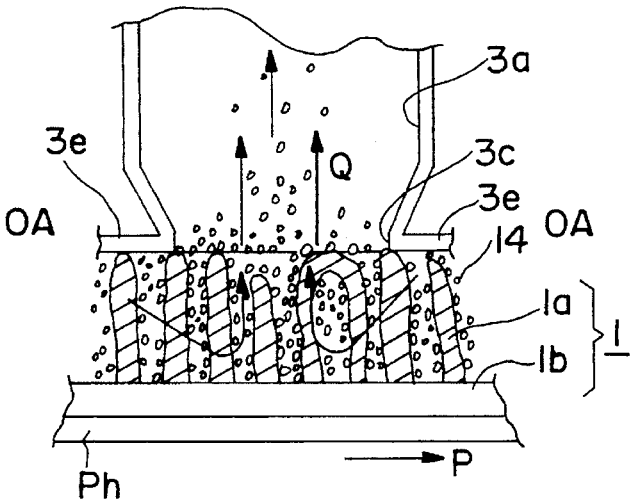
FIG. 9 is an enlarged drawing of continuous water drops becoming minute water drops by the negative pressure air stream from the sucking-out nozzle with flanges.

With respect to the embodiment of the present invention shown in FIGS. 7, 8 and 9, drying this type of mat occurs by using a dehydrating device comprising a sucking-out nozzle 3*c* having flanges at the tip of its circumference. The principle of the dehydration process is now explained. Water membranes 12 change to continuous water drops 13 by the high speed negative pressure air stream Q. The sucking force of the sucking-out nozzle 3*c* overcomes the surface tension and the viscosity of the water drops 13. The water drops are subdivided into minute water drops 14 as shown in FIG. 9. The water drops 14 are extracted from the fibers 1*a* and sucked into the sucking-out pipe 3*a* by the high speed negative pressure air stream and externally exhausted with the water vapor. As mentioned above, water drops 14 on the mat 1 are continuously sucked out and removed from the roots of the fibers 1*a* to dehydrate the mat 1 by using the sucking-out nozzle 3*c* having a flange 3*e*.

As stated above, FIGS. 21, 23, 24 and 25 show an embodiment of the present invention in which drying using a component 3 comprises a contiguous sucking-out nozzle 3*c* and blowing nozzles 3*d*. The principle of this dehydrating and drying method is now explained. The high speed air jet stream R flows in the high speed negative pressure air stream region and is accelerated by a multiplication effect of the high speed air jet stream R and the high speed negative pressure air stream Q. The negative pressure air stream has a strong sucking force on the group of fibers. The water membrane 12 on the fibers and the water 12*a* between the fibers (FIG. 23) changes to continuous water drops 13 (FIG. 24) by a multiplication effect of the dynamic pressure of the high speed air jet stream R and sucking force of the high speed negative pressure air stream Q between the fibers. The water drops 13 overcome the surface tension and the viscosity of the water and are subdivided into minute water drops 14 (FIG. 25). These water drops 14 are extracted from the fibers 1*a* and sucked into the high speed negative pressure air stream Q in the sucking-out nozzle 3*c* and externally exhausted with the water vapor. This results in a dry article.

Drying using a sucking force from only the sucking-out nozzle 3*c* requires several times the time compared with the case of drying with a component 3 comprising a sucking-out nozzle 3*c* and blowing nozzle(s) 3*d*.

Figure 44:
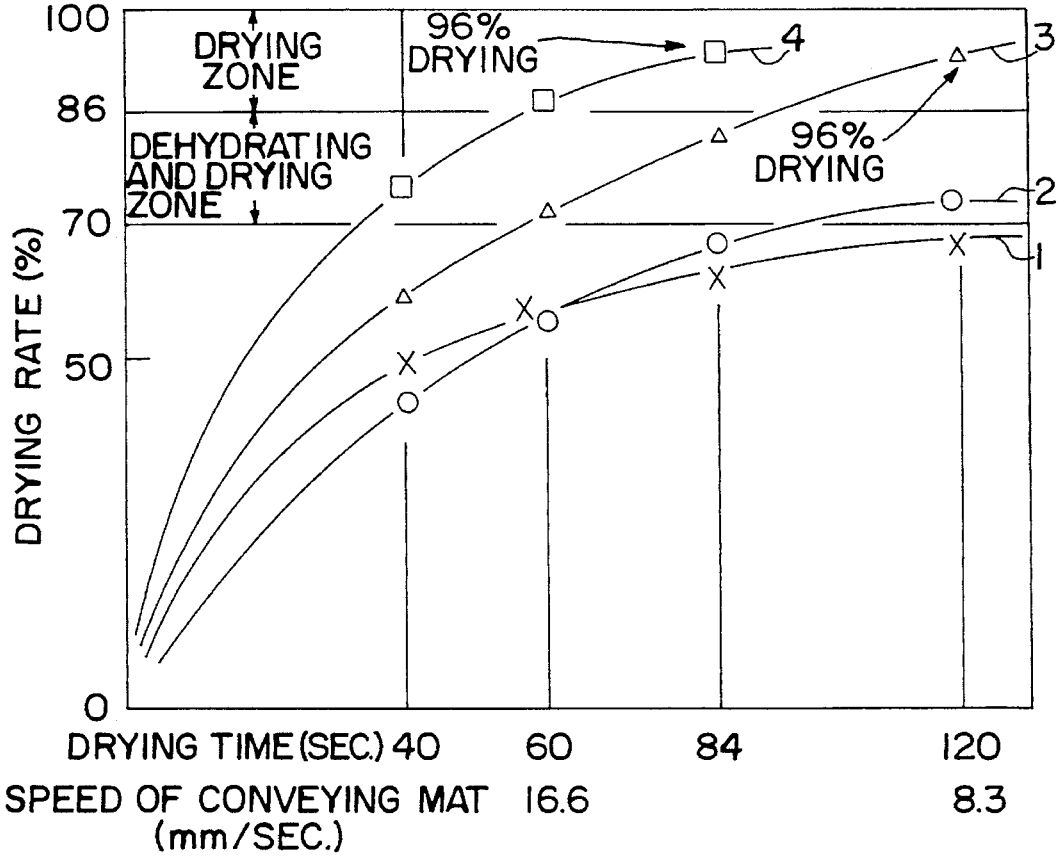
FIG. 44 is a graph showing results of drying by a dehydrating and drying device using components with and without flanges according to the present invention.

The curve 3 in the graph of FIG. 44 shows the result of a drying test according to the embodiment of the present invention shown in FIGS. 21, 23, 24 and 25, in which the size of the implanted mat, i.e., the article to be dried, is 1m×1m, the transferring speed of the implanted mat is 8.3 mm/sec., the jet stream temperature is 50° C., the static pressure in the sucking-out nozzle 3*c* is −1300 mmAq, the static pressure in the blowing nozzle 3*d* is +1300 mmAq, and the component 3 is not provided with a flange. The mat weighed 1000 g before washing and 1800 g after washing. Therefore, the wet mat contained 800 g of water. The drying ratio is as given by the following formula:

Drying ratio (%) =

-continued $$\left\{ 1 - \frac{\text{weight of attached water after drying}}{\text{weight of attached water before drying}} \right\} \times 100$$

The principle of dehydrating and drying a wet mat 1 using a component 3 comprising a sucking-out nozzle 3*c* and blowing nozzles 3*d*, both provided with flanges 3*e* , 3*f* and 3*h* at there tips as shown in FIG. 1, is described in detail above with respect to FIGS. 21, 23, 24 and 25.

Flanges 3*e*, 3*f* and 3*h* are provided at the tip end circumferences of the component 3. The high speed air jet stream R passes over the surfaces of the flanges 3*e* , 3*f* and 3*h* contacting the tips of the fibers 1*a* of the mat 1 and does not form a short cut with the high speed negative pressure air stream Q. Rather, the high speed air jet stream R flows deeply and reaches to the roots of the fibers compared with the case in which a component without flanges is used. Since the jet stream R and negative pressure stream Q do not form a short cut with the outer air, static pressure in the nozzles does not drop, the high speed air jet stream R flows into the negative pressure air stream region, the high speed negative pressure air stream Q is accelerated by the multiplication effect of both streams and sucks out the water drops and water vapor from the sucking-out nozzle 3*c* to provide continuous dehydrating and drying of the article. The drying time can be shortened approximately 30% compared with the case in which the component 3 without flanges is used (FIG. 44).

As described in the embodiment of the present invention shown in FIG. 29, in the component 3 comprising a sucking-out nozzle 3*c* and blowing nozzles 3*d*, both having flanges, when the component 3 is designed such that a high speed air jet stream R flows obliquely with respect to the mat 1 (FIGS. 36–38), it contributes to transferring the article to be dried and a higher dehydrating and drying efficiency can be obtained.

In FIG. 29, when only the second stage dehydrating and drying device 40 is used, the drying ratio is shown as line 4 in the graph of FIG. 44.

In FIG. 44, curve 4 shows data when a component 3B with flanges is used as shown in FIG. 29, and curve 3 shows data when a component without flanges is used. In the former case 84 seconds was needed for achieving the drying ratio of 96%, and in the latter case 120 seconds was needed for achieving the same drying ratio.

In FIG. 44, curve 1 shows data when the dehydrating and drying process employed only a high speed negative pressure air stream Q with a sucking-out nozzle 3*c* without flanges in its circumference, and curve 2 shows data when the dehydrating and drying process employed only a high speed air jet stream R with a blowing nozzle 3*d* without flanges in its circumference. The data in FIG. 44 show that drying by a high speed negative pressure air stream Q in the sucking-out nozzle 3*c* provides an increased drying ratio at the former half stage of the drying and that drying by a high speed air jet stream R with the blowing nozzle 3*d* provides an increased drying ratio at the latter half stage of the drying process. In FIG. 44, the dehydrating and drying conditions are as follows:

static pressure in the sucking-out pipe: −1300 mmAq static pressure in the blowing pipe: +1300 mmAq size of the implanted mat: 1 m×1 m thickness of the implanted mat: fibers 7 mm and base 3 mm conveying speed of the implanted mat: 8.3 mm/sec.

temperature of the jet stream: 50° C.

weight of the mat containing water: 1800 g (1000 g (net weight of mat)+800 g (water)=1800 g)

outer air: temperature 25° C., relative humidity 54%.

Figure 45:
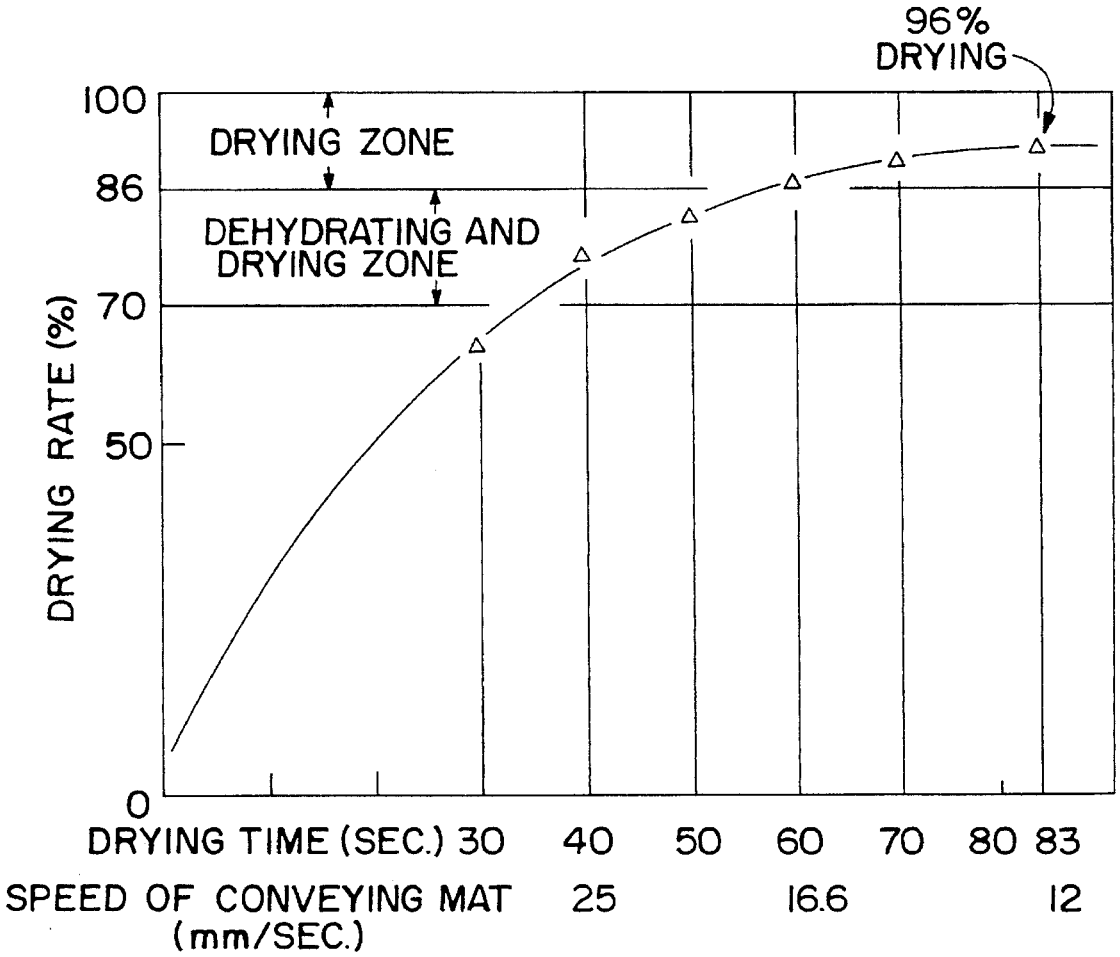
FIG. 45 is a graph showing a result of two-stage drying using two components having flanges according to the present invention.

In FIG. 29, when the dehydrating and drying devices 30 and 40 are used, the drying ratios are shown in the graph of FIG. 45, in which two components 3A and 3B have flanges at the tip end circumferences and drying was performed in two stages. In FIG. 45, the dehydrating and drying conditions are as follows:

sucking-out negative pressure at the first stage: −1500 mmAq sucking-out negative pressure at the second stage: −300 mmAq static pressure in the blowing nozzle at the first stage: +300 mmAq static pressure in the blowing nozzle at the second stage: +1500 mmAq size of the implanted mat: 1 m×1 m thickness of the implanted mat: fibers 7 mm and base 3 mm conveying speed of the mat: 12 mm/sec.

temperature of the jet stream at the first stage: 50° C.

temperature of the jet stream at the second stage: 60° C.

net weight of the mat (FIG. 43): 1000 g maximum water content of the mat: 800 g weight of the wet mat: 1800 g water content ratio: 80% outer air: temperature 25° C., relative humidity 54%.

The wet mat 1 is dehydrated in the first stage dehydrating device and at the same time conveyed. It is then dried in the second stage drying device. When dehydration and drying were provided for 83 seconds, 768 g out of 800 g of water could be removed to achieve a drying ratio of 96%.

Therefore, at the first stage dehydration the pressure of the high speed negative pressure air stream Q is raised (−1500 mmAq) and the pressure of the high speed air jet stream R is weakened (+300 mmAq). At the second stage drying the pressure of high speed air jet stream R is raised (+500 mmAq) and the pressure of the high speed negative pressure air stream Q is weakened (−300 mmAq) to improve the drying efficiency and to save energy.

Figure 46:
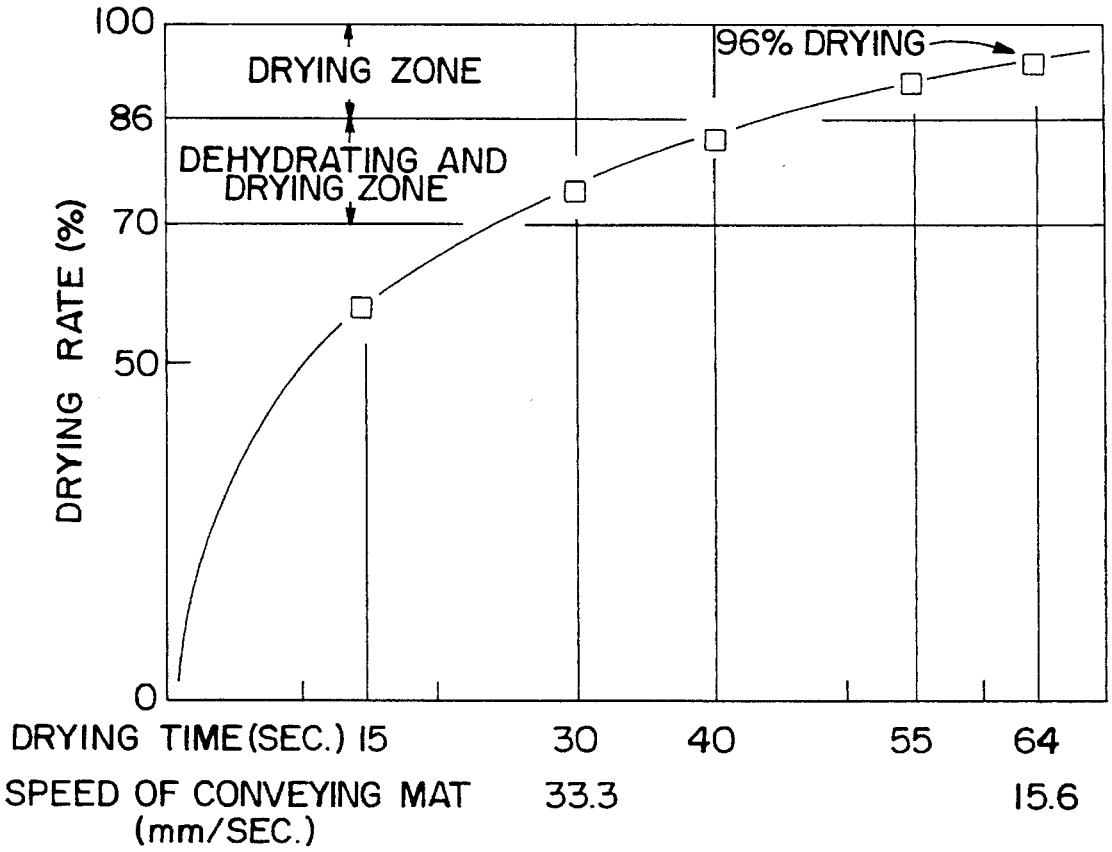
FIG. 46 is a graph showing a result of three-stage dehydrating and drying using three sets of components having flanges.

FIG. 46 shows data of the three stage drying using three components A, 3B and 3B having flanges at their tip end circumferences and using dehydrating and drying devices 30, 40 and 50 as shown in FIG. 29. In FIG. 46, the dehydrating and drying conditions are as follows:

sucking-out negative pressure at the first stage: −1500 mmAq sucking-out negative pressure at the second stage: −700 mmAq sucking-out negative pressure at the third stage: −300 mmAq static pressure in the blowing nozzle at the first stage: +300 mmAq static pressure in the blowing nozzle at the second stage: +1300 mmAq static pressure in the blowing nozzle at the third stage: +1500 mmAq size of the implanted mat: 1 m×1 m thickness of the implanted mat: fibers 7 mm and base 3 mm conveying speed of the mat: 15.6 mm/sec.

temperature of the jet stream at the first stage: 40° C.

temperature of the jet stream at the second stage: 50° C.

temperature of the jet stream at the third stage: 65° C.

net weight of the mat: 1000 g maximum water content of the mat: 800 g weight of the wet man: 1800 g outer air: temperature 25° C., relative humidity 54%.

The wet mat was dehydrated in the first stage dehydrating device 3A and then dried in the second and third stage drying devices 3B. When dehydration and drying was provided for 64 seconds, a drying ratio of 96% was achieved.

As described above, the static pressure in the sucking-out nozzle 3*c* is raised at the pre-stage to suck out and remove most of the water and is lowered at the latter stage. On the other hand, the static pressure in the blowing nozzle 3*d* is lowered at the pre-stage and raised at the latter stage to remove the remaining water after the pre-stage dehydrating. This provides efficient drying and saves energy.

The energy necessary for this dehydrating and drying process requires five blowers of 3.3 KWH, a heater for heating an air jet stream R of 3 KWH and a driving motor of 0.5 KWH. This sums up to approximately 20 KWH which costs 400 yen/hour when the electricity rate is calculated at approximately 20 yen per 1 KWH. The drying time per 1 m×1 m mat mentioned above is approximately 60 seconds which means it costs approximately 6.6 yen. This is an extremely low electricity cost.

The above examples were explained using, as articles to be dried, a mat having a base material comprising a rubber sheet and an air-permeable carpet. The present invention is not limited to these material and can be used for wide carpet, cloths, fabrics such as woven fabrics, non-woven fabrics, glass fiber sheet, synthetic fiber sheet, other long sheets, artificial turf, thin mats of rush, thick mats of rush and straw, cardboard, fire hose and electronic parts requiring drying at low temperature after washing and of course for drying during a manufacture process of any of the above.

In drying a mat, prior dehydrating drying using centrifugal force, drying by using both pressure decrease and hot air, and simple heat drying are used. However, uniform drying cannot be achieved and drying must be performed at a rather high temperature of 80°–120° C. during drying using heat. Some types of cloth need to be dried at temperatures lower than 50° C. This requires a long time in low-temperature drying. In the dehydrating and drying device of the present invention using a high speed negative pressure air stream Q, water adhered to the fiber surface and fiber gaps is evaporated and physically extracted by negative pressure near the sucking-out nozzle 3*c*, for example, by a high speed negative pressure air stream Q of approximately −300 mmAq to −1500 mmAq. Minute water drops are removed by the negative pressure air stream Q, the temperature of an article to be dried by water vaporization is not decreased, a high speed drying in low temperature is achieved, the device is simplified, heating energy is not great, money is saved and an extremely high drying efficiency is achieved.

When a high speed negative pressure air stream Q of the sucking-out nozzle 3*c* and a high speed air jet stream R from the blowing nozzle 3*d* are used in the present invention, dry air as the high speed air jet stream R is blown at numerous fiber gaps to the fiber root to promote drying and at the same time the air jet stream blows into the negative pressure stream zone near the sucking-out nozzle 3*c* to transfer water instantaneously into the sucking-out nozzle 3*c* due to a multiplication effect of the high speed negative pressure air stream Q and the high speed air jet stream R. As drying is performed in this manner, the drying efficiency is increased. The drying efficiency is further increased, of course, when hot air of approximately 40°–65° C. is used as the high speed air jet stream R. Compared with energy use in a case of drying by blown hot air in the prior art for example, it was observed that the energy use is decreased by half by using a dehydrating and drying device of the present invention which uses both the sucking-out nozzle 3*c* and the jet blowing nozzle 3*d*.

When a dehydrating and drying device of the present invention is used, dehydrating and drying can be provided by using only a sucking-out nozzle 3*c* in the apparatus shown in FIG. 39, depending on the type of article to be dried. On the other hand, dehydrating and drying can be provided by using only a blowing nozzle 3*d*.

By dividing the dehydrating and drying device of the present invention into a preceding-stage dehydrating device which dehydrates in a preceding zone and a following stage drying device which performs drying in a following zone as shown in FIGS. 39 and 29, the pressure of the high speed air jet stream R and pressure of the negative pressure air stream Q can be regulated and drying energy can be conserved.

By providing a barrier wall such as a flange or a bulging part in the circumferential part of the tips of the sucking-out nozzle 3*c* of the present invention or in the circumferential part of the tips of the sucking-out nozzle 3*c* and the blowing nozzle 3*d* in the components, air does not flow from the blowing nozzle 3*d* directly into the sucking-out nozzle 3*c* through a short cut and does not directly suck outer air OA. Rather, air goes deeply into fiber roots from the surface of the article to be dried such as a mat, carpet, etc. By using a high speed negative pressure air stream Q or by employing a multiplication effect of the high speed negative pressure air stream Q and the high speed air jet stream R (both streams being accelerated), water attached to the surface and gaps of fibers in the carpet, etc., can be quickly extracted and removed from the sucking-out nozzle 3*c* to provide continuous dehydrating and drying. Therefore, the consumption of water vaporization heat is largely decreased, temperature decrease of the article to be dried is prevented, rapid drying in low temperature is possible, increased heating energy is unnecessary contributing to energy saving, cost is decreased, drying is performed in an extremely short time making drying efficiency extremely high, there is no deterioration of the article to be dried by high temperature, there is no damage by friction, and there is no fear of producing wrinkles in the article to be dried. Additionally, along with water drop removal, foreign matters such as dust and especially ticks, lice, other injurious vermin and their eggs attached to the articles to be dried can be completely sucked and removed by the high speed negative pressure air stream Q. Thus cleaning and germfree effects are achieved along with obtaining a clean and dry carpet.

Drying efficiency further increases when hot air of 40°–65° C., for example, is used as the high speed air jet stream R. For example, an implanted mat having a rubber liner of 1 m×1 m width and 10 mm thickness can be dehydrated and dried in approximately 1 minute (FIG. 46) using three sets of components having a sucking-out nozzle 3*c* and a blowing nozzle 3*d*, both having flanges at the circumferences of their tips.

Dehydrating and drying devices having only sucking-out nozzles 3*c* provided with flanges or combinations of both the sucking-out nozzles 3*c* with flanges and the blowing nozzle 3*d* with flanges can be selected depending on the type or the thickness of the article to be dried.

When both the sucking-out nozzles 3*c* with flanges and blowing nozzles 3*d* with flanges are used, dehydrating and drying in low temperature can be performed in an extremely short time due to the multiplication effect achieved by the high speed air jet stream R accelerating in the region of the high speed negative pressure air stream Q. When cloths which are hard to be dried, such as tightly woven fabrics, are dried, as shown in FIG. 29, it is preferable to raise the sucking force of the high speed negative pressure air stream Q (for example to −1500 mmAq) and to weaken the air jet stream in the preceding zone 30 since the article to be dried contains a large amount of water. In the second zone 40 and the third zone 50, however, the pressure of the high speed air jet stream R is raised (for example, to approximately +1300 mmAq–+1500 mmAq) and the high speed negative pressure air stream Q is weakened to perform efficient drying.

The foregoing is considered as illustrative only of the principles of the present invention. Since numerous modifications and changes will readily occur to those skilled in the art, it is not desired to limit the invention to the exact construction and applications shown and described, and accordingly, all suitable modifications and equivalents may be resorted to, falling within the scope of the invention and the appended claims and their equivalents.

For example, the present invention has been explained using drying of an article which is wet with water as an example. When liquids other than water such as trichloroethylene or other organic solvents or mixtures of a liquid and water are used for washing, and the articles are to be dried, the water drop separating vessel mentioned above can be used as a solvent or other liquid drop separating vessel, and a solvent vapor adsorbing/removing device can be used in place of or in addition to a dehumidifier to concentrate and recover the solvent or to use it as a fuel. This results in a device being used as a rapid drying device in low temperature in a similar way as with water removal.

We claim:

1. A rapid dehydrating and drying device usable at a low temperature, comprising:

a component including a blowing nozzle and a sucking-out nozzle;

a wet article to be dried placed close to and sliding on tips of said sucking-out nozzle and said blowing nozzle; and a high speed air jet stream and a high speed negative pressure air stream simultaneously applied by said blowing nozzle and said sucking-out nozzle, respectively, to said wet article to be dried, for directly sucking out water drops and water vapor from said wet article to be dried.

2. A rapid dehydrating and drying device according to claim 1, further comprising one or more sucking-out nozzles and one or more blowing nozzles arranged alternately and in combination.

3. A rapid dehydrating and drying device according to claim 2, wherein the sucking pressure of said sucking-out nozzle is made strong during an initial step when said wet article to be dried contains a large amount of water, to suck out water drops to dehydrate, and the blowing pressure is made strong when said wet article is fully dehydrated, and at the same time the temperature of said high speed air jet stream is raised in a range to promote drying such that said wet article is not heat-deteriorated when dehydrated.

4. A rapid dehydrating and drying device usable at a low temperature comprising:

a wet article to be dried;

a sucking-out pipe having a sucking-out nozzle; and a blowing pipe having a blowing nozzle placed inside said sucking-out pipe, a high speed air jet stream and a high speed negative pressure air stream of both said blowing pipe and said sucking-out pipe, respectively, acting on said wet article to be dried as it is transferred, water drops and water vapor being sucked out directly and powerfully from said wet article to be dried by said high speed air jet stream and said high speed negative pressure air stream to dry said wet article.

5. A rapid dehydrating and drying device according to claim 4, further comprising a plurality of sucking-out pipes and a plurality of blowing pipes.

6. A rapid dehydrating and drying device according to claim 5, wherein the sucking pressure of said sucking-out nozzle is made strong during an initial step when said wet article to be dried contains a large amount of water, to suck-out water drops to dehydrate, and the blowing pressure is made strong when said wet article is fully dehydrated, and at the same time the temperature of said high speed air jet stream is raised in a range to promote drying such that said wet article is not heat deteriorated when dehydrated.

7. A rapid dehydrating and drying device according to claim 1, further comprising a blowing pipe connected to said blowing nozzle and a sucking-out pipe connected to said sucking-out nozzle, said sucking-out pipe being placed inside of said blowing pipe.

8. A rapid dehydrating and drying device according to claim 7, further comprising a plurality of blowing-pipes and sucking-out pipes.

9. A rapid dehydrating and drying device according to claim 8, wherein the sucking pressure of said sucking-out nozzle is made strong during an initial step when said wet article to be dried contains a large amount of water, to suck-out water drops to dehydrate, and the blowing pressure is made strong when said wet article is fully dehydrated, and at the same time the temperature of said high speed air jet stream is raised in a range to promote drying such that said wet article is not heat-deteriorated when dehydrated.

10. A rapid dehydrating and drying device according to claim 1, wherein said high speed air jet stream is injected obliquely to the surface of said wet article to be dried.

11. A rapid dehydrating and drying device according to claim 1, further comprising a blower, said blower forming a circulatory air flow route.

12. A rapid dehydrating and drying device according to claim 1, further comprising a water drop separating vessel provided between said sucking-out nozzle and an inlet of said blowing nozzle.

13. A rapid dehydrating and drying device according to claim 1, further comprising a dehumidifier provided in front of an inlet of said blowing nozzle.

14. A rapid dehydrating and drying device according to claim 1, wherein said wet article to be dried includes a liquid selected from a group consisting of one of a volatile liquid other than water and a mixture of said volatile liquid and water.

15. A rapid dehydrating and drying device according to claim 14, further comprising a gas-liquid separating vessel provided between said sucking-out nozzle and an inlet of said blower.

16. A rapid dehydrating and drying device according to claim 14, further comprising:

a blower for sucking and for blowing to circulate air; and an adsorber, coupled between said inlet of said blower and said sucking-out nozzle, for adsorbing and removing vapor of said volatile liquid.

17. A rapid dehydrating and drying device according to claim 1, further comprising a flange provided at a circumferential part of tips of said sucking-out nozzle and said blowing nozzle.

18. A rapid dehydrating and drying device according to claim 17, wherein said flange having one of a plurality of grooves and ribs provided on a surface of said flange facing said wet article to be dried.

19. A rapid dehydrating and drying device according to claim 1, further comprising:

a wire conveyor located at an underside of said wet article to be dried; and a roller conveyor located at an upper side of said wet article to be dried.

20. A rapid dehydrating and drying method usable at a low temperature, comprising the steps of:

a) sliding a wet article to be dried along tips of a sucking-out nozzle and a blowing nozzle;

b) simultaneously applying a high speed air jet stream and a high speed negative pressure air stream by the sucking-out nozzle and the blowing nozzle, respectively; and c) directly sucking-out water drops and water vapor from the wet article to be dried by the high speed air jet stream and the high speed negative pressure air stream.

21. A rapid dehydrating and drying method, according to claim 20, further comprising the step of:

d) arranging one or more sucking nozzles and one or more blowing nozzles alternately and in combination.

22. A rapid dehydrating and drying method according to claim 21, comprising the substeps of:

i) making the sucking pressure of the sucking-out nozzle strong during an initial step of said method to suck out water drops to alehydrate the wet article when the wet article to be dried contains a large amount of water; and ii) making the blowing pressure strong when the article is fully dehydrated and at the same time raising the temperature of the high speed air jet stream to be within a range such that the dehydrated wet article to be dried does not heat deteriorate.

23. A rapid dehydrating and drying method according to claim 20, further comprising the step of:

d) injecting an air stream obliquely to the surface of the article to be dried.

24. A rapid dehydrating and drying method according to claim 20, comprising the step of:

d) employing a blower for making a circulatory air flow route.

25. A rapid dehydrating and drying method according to claim 20, further comprising a substep of providing a water drop separating vessel between the sucking-out nozzle and an inlet of a blower attached to the blowing nozzle.

26. A rapid dehydrating and drying method according to claim 20, further comprising a substep of providing a dehumidifier in front of an inlet of a blower attached to the blowing nozzle.

27. A rapid dehydrating and drying method according to claim 20, further comprising the substep of drying one of a volatile liquid, other than water and a mixture of a volatile liquid and water, present in the article to be dried.

28. A rapid dehydrating and drying method according to claim 27, further comprising a substep of separating a gas and a liquid in a gas-liquid separating vessel located between the sucking-out nozzle and an inlet of a blower connected to the blowing nozzle.

29. A rapid dehydrating and drying method according to claim 27, further comprising the substeps of:

i) providing a blower for sucking and blowing to circulate air; and ii) providing an apparatus for adsorbing and removing vapor of the volatile liquid.

30. A rapid dehydrating and drying method according to claim 20, comprising the substep of:

i) transferring the article to be dried using a wire conveyor and a roller conveyor.

* * * * *

UNITED STATES PATENT AND TRADEMARK OFFICE

CERTIFICATE OF CORRECTION

PATENT NO. : 5,548,905

DATED : August 27, 1996

INVENTOR(S) : Toshimi KUMA, et al.

It is certified that error appears in the above-indentified patent and that said Letters Patent is hereby corrected as shown below:

Col. 7, line 52, after "input" insert --to--.

Col. 16, line 46, change "A" to --3A--.

Col. 17, line 7, change "man" to --mat--.

Col. 21, line 31, change "alehydrate" to --dehydrate--.

Signed and Sealed this

Twenty-eighth Day of January, 1997

*Attest:*

Bruce Lehman

BRUCE LEHMAN

*Attesting Officer*

*Commissioner of Patents and Trademarks*